US006619862B1

(12) United States Patent
Piccinino, Jr. et al.

(10) Patent No.: US 6,619,862 B1
(45) Date of Patent: Sep. 16, 2003

(54) THERMAL MANAGEMENT DRUM FOR A PHOTOGRAPHIC PROCESSOR

(75) Inventors: Ralph L. Piccinino, Jr., Rush, NY (US); Faye Transvalidou, Rochester, NY (US); Jeffrey L. Hall, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/185,185

(22) Filed: Jun. 28, 2002

(51) Int. Cl.[7] ..... G03D 3/08; G03D 13/00; G03D 3/04

(52) U.S. Cl. ..... 396/571; 396/620; 396/625; 396/626; 396/635

(58) Field of Search ..... 396/571, 576, 396/612, 620, 625, 626, 634, 635; 355/27–29, 40.41

(56) References Cited

U.S. PATENT DOCUMENTS 3,672,290 A * 6/1972 Duesler ..... 396/571
5,845,169 A * 12/1998 Patton et al. ..... 396/612
6,020,948 A * 2/2000 Tumidei ..... 355/27
6,082,908 A * 7/2000 Tumidei ..... 396/625
6,322,261 B1 * 11/2001 Kuzyk ..... 396/635
6,485,202 B1 * 11/2002 Piccinino et al. ..... 396/635
6,485,204 B1 * 11/2002 Piccinino et al. ..... 396/634
6,517,261 B1 * 2/2003 Piccinino et al. ..... 396/571
6,517,263 B1 * 2/2003 Piccinino et al. ..... 396/625

* cited by examiner

*Primary Examiner*—D. Rutledge
(74) *Attorney, Agent, or Firm*—David A. Novais

(57) ABSTRACT

The present invention relates to a photographic processor and a method of processing photographic material where heat is applied to a processing drum in a manner which requires less warm up time and permits better film processing uniformity. The system of the present invention includes a circular drum and a heating material provided either on an outer surface of the drum, embedded into a side wall of the drum, or provided in an interior surface of the drum. The heating material is adapted to be heated so as to heat the processing path through which film is conveyed during processing, to an appropriate temperature for the processing of the photographic material.

17 Claims, 26 Drawing Sheets

THERMAL MANAGEMENT DRUM FOR A PHOTOGRAPHIC PROCESSOR

CROSS REFERENCE TO RELATED APPLICATIONS

The present application is related to the following pending patent applications: U.S. patent application Ser. No. 10/027,382 filed Dec. 21, 2001, now U.S. Pat. No. 6,185,202, entitled PHOTOGRAPHIC PROCESSOR AND METHOD OF OPERATION; U.S. patent application Ser. No. 10/027,454 filed Dec. 21, 2001, now U.S. Pat. No. 6,517,261, entitled A PROCESSING SOLUTION DELIVERY SYSTEM HAVING A SUPPLY TUBE AND LEVEL DETECTION SENSOR UNIT FOR USE WITH A PHOTOGRAPHIC PROCESSOR; U.S. patent application Ser. No. 10/027,381 filed Dec. 21, 2001, now U.S. Pat. No. 6,485,204, entitled PHOTOGRAPHIC PROCESSOR HAVING AN ADJUSTABLE DRUM; U.S. patent application Ser. No. 10/027,432 filed Dec. 21, 2001, entitled CHEMICAL DELIVERY SYSTEM FOR USE WITH A PHOTOGRAPHIC PROCESSOR AND METHOD OF OPERATION U.S. patent application Ser. No. 10/108,141 filed Mar. 27, 2002, now U.S. Pat. No. 6,517,263, entitled PHOTOGRAPHIC PROCESSOR HAVING SIDE BY SIDE PROCESSING PATHS AND METHOD OF OPERATION and U.S. patent application Ser. No. 10/164,067 entitled PROCESSING SOLUTION DELIVERY SYSTEM FOR USE WITH A PHOTOGRAPHIC PROCESSOR AND METHOD OF OPERATION.

FIELD OF THE INVENTION

The present invention is directed to a photographic processor having a thermally heated drum and a method of operation.

BACKGROUND OF THE INVENTION

Photographic processors come in a variety of shapes and sizes from large wholesale photographic processors to small micro-labs. As photographic processors become more and more technologically sophisticated, there is a continued need to make the photographic processor as user-friendly and as maintenance-free as possible.

Currently available photographic processors have one or more of the following shortcomings: (1) the film processing time is relatively long; (2) some photographic processors, because of their size, require a large amount of space; (3) some photographic processors may require an unacceptable amount of processing solution due to the design of the processing tank; (4) some photographic processors generate an unacceptable amount of processing solution waste due to the design of the processing tank; and (5) some photographic processors waste energy by heating an entire processing chamber instead of focusing the heat on an area such as a film path, so that the heat can be applied and used in a more efficient manner.

SUMMARY OF THE INVENTION

The present invention addresses some of the difficulties and problems discussed above by the discovery of a novel, compact, and portable photographic processor having an internal drum design, which minimizes the chemicals required to process a roll of film, minimizes the amount of waste generated per roll of film processing and minimizes the amount of heat needed for heating the processing chamber of the processor. The photographic processor is extremely user-friendly and low maintenance.

The present invention provides for a system which places heat where it is required most in a processing apparatus. More specifically, the present invention provides for a system where the heat is placed in the vicinity of a film plane surface as opposed to heating an entire processing chamber of a processor. With the system and method of the present invention, the heating of a processor such as a processing drum is done in a manner which requires less area to be heated, less time and gives better film uniformity results.

The system and method of the present invention provides for improved heating capabilities by using thermally conductive materials. For example, thermally conductive material can be placed on film tracks or a film path inside of a processing drum of a processor, can be embedded into the processing drum or can be provided on an exterior of the processing drum. Using the conductive material along with the non-conductive material allows the drum to be heated from the inside or the outside and permits the drum to act as an insulator which helps maintain the temperature of the track or path for a longer period of time. On the other hand, the drum can be entirely made out of a thermally conductive material and heated from the outside using heat tape, radiant heat, a heat gun, or any other heating means known in the industry.

The present invention accordingly provides for a photographic processor which comprises a circular processing drum having a front wall, a back wall, and a side wall connecting the front wall to the back wall and extending around the perimeter of the drum, with the front wall, back wall and side wall defining a processing chamber for holding processing solution therein and a processing path within the processing chamber along which a photographic material is conveyed during processing; and a heating material provided on an outer surface of the side wall so as to extend around the perimeter of the drum. The heating material is adapted to be heated to heat at least the circular processing drum and the processing path to an appropriate temperature for processing of the photographic material.

The present invention further relates to a photographic processor which comprises a circular processing drum having a front wall, a back wall, and a side wall connecting the front wall to the back wall and extending around the perimeter of the drum, with the front wall, the back wall, and the side wall defining a processing chamber for holding processing solution therein and a processing path within the processing chamber along which a photographic material is conveyed during processing; and a heating material embedded into the sidewall and extending around the perimeter of the drum. The heating material is adapted to be heated to heat at least the circular processing drum and the processing path to an appropriate temperature for processing of the photographic material.

The present invention further relates to a photographic processor which comprises a circular processing drum having a front wall, a back wall, and a side wall as noted above, wherein the circular drum itself is made of a thermally conductive material and is adapted to be heated to heat at least the processing path to an appropriate temperature for processing of the photographic material.

The present invention further relates to a photographic processor which comprises a circular processing drum having a front wall, a back wall, and a side wall as noted above, wherein an interior surface of the side wall and opposing portions of the back and front walls adjacent to the side wall define a film processing path along which film to be processed is conveyed. The processor further comprises a thermally conductive insert provided in the side wall in the vicinity of the interior surface of the side wall, with the thermally conductive insert being adapted to be heated to heat at least the interior surface of the side wall and the processing path to an appropriate temperature for processing of the photographic material.

The present invention further relates to a method of processing photographic material which comprises the steps of introducing a processing solution into a processing drum having a front wall, a back wall and a side wall connecting the front wall to the back wall and extending around the perimeter of the drum; introducing photographic material into a processing path of the processing drum to contact the processing solution and process the photographic material; and energizing a heating material provided on an outer surface of the side wall to heat at least the processing path to an appropriate temperature for processing of the photographic material.

The present invention further relates to a method of processing photographic material which comprises the steps of introducing a processing solution into a processing drum having a front wall, a back wall, and a side wall connecting the front wall to the back wall and extending around the perimeter of the drum; introducing photographic material into a processing path of the processing drum to contact the processing solution and process the photographic material; and energizing a heating material embedded into the side wall to heat at least the processing path to an appropriate temperature for processing of the photographic material.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION OF THE INVENTION

Figure 1:
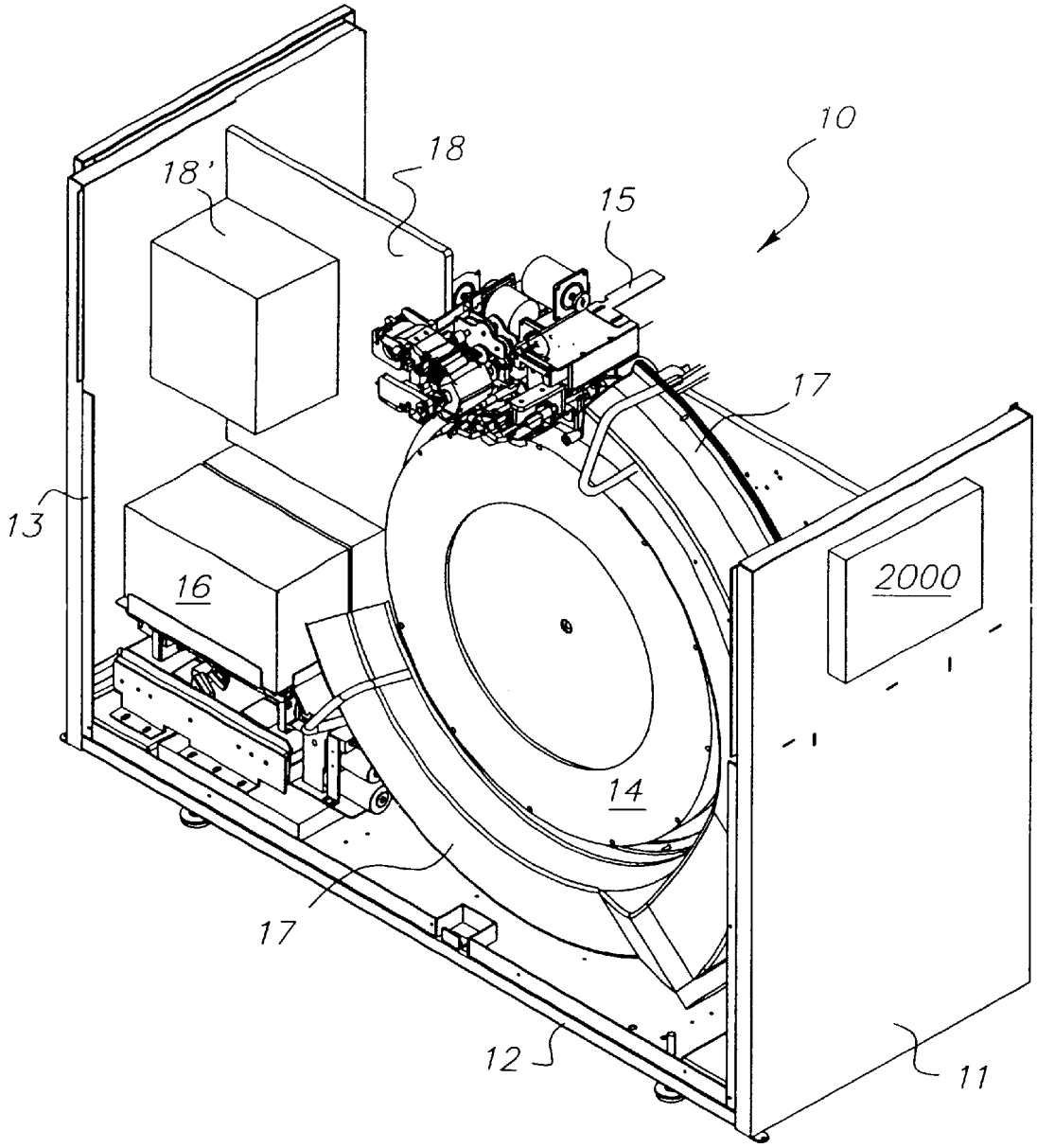
FIG. 1 is a frontal view of an exemplary photographic processor of the present invention.

The present invention is directed to photographic processors. An exemplary photographic processor of the present invention is shown in FIG. 1. The photographic processor 10 comprises at least an outer housing, which includes a first side wall 11, a base housing member 12, and second side wall 13. The photographic processor 10 includes a circular processing chamber 14 (also referred to herein as the "circular processing drum 14"), which may be used to treat a given strip or roll of film to one or more photoprocessing solutions or chemicals. Photographic processor 10 further includes a film-loading/unloading device 15 positioned above and cooperating with circular processing drum 14. A chemical delivery system 16 is positioned for easy access by a user (i.e., for maintenance or replacement purposes) at a location near side wall 13 and base housing member 12. Photographic processor 10 also includes a circular dryer 17 in the form of, for example, a cylinder, for drying the processed film. Dryer 17 is concentrically and co-axially positioned around processing drum 14. Once a given strip or roll of film is dried in dryer 17, the film proceeds to a scanner 18', which may be positioned above chemical delivery system 16 in a space bordered by side wall 13 and left interior wall 18 or any other convenient location.

Figure 2:
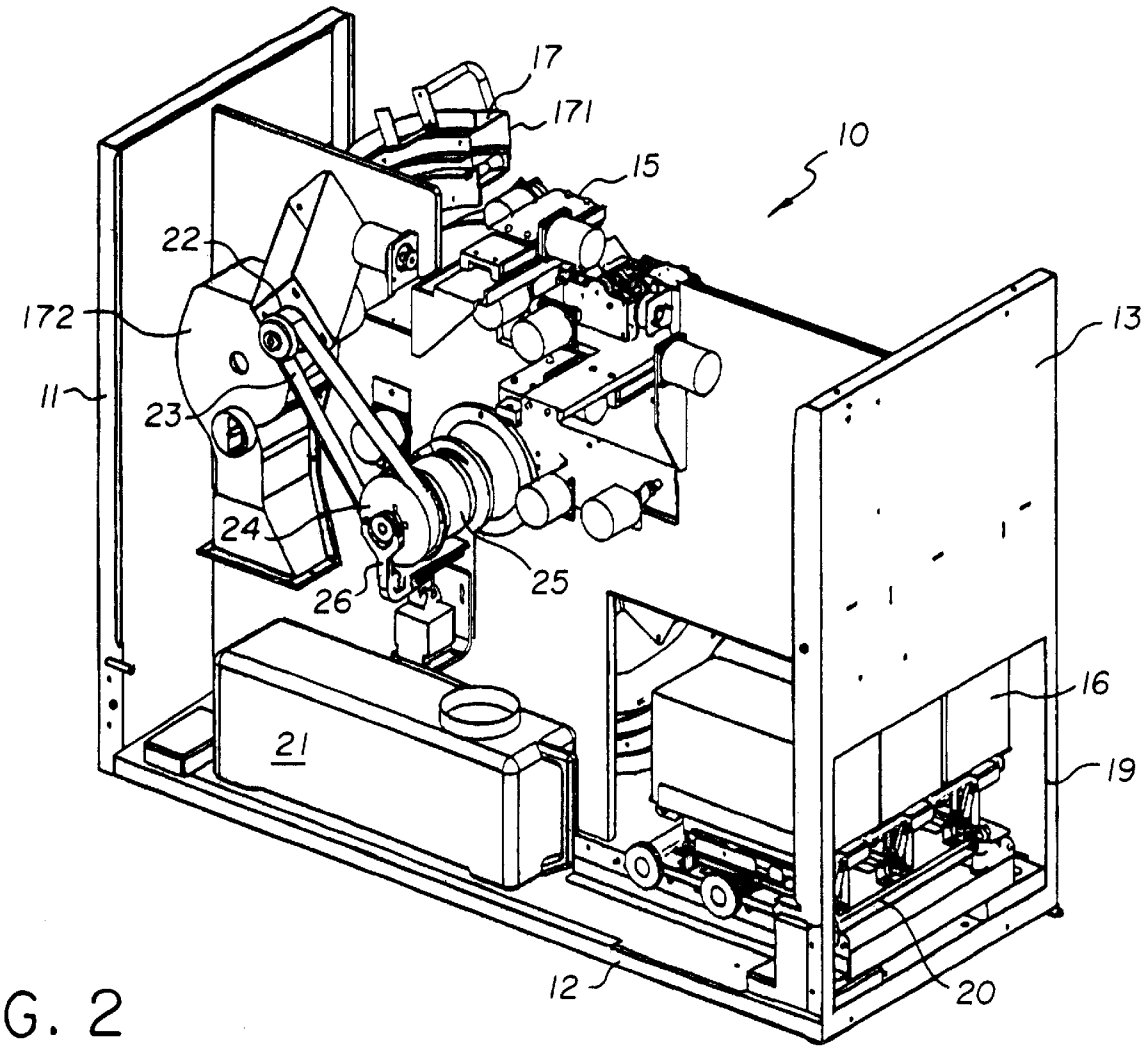
FIG. 2 is a rear view of an exemplary photographic processor of the present invention.

FIG. 2 depicts a rear view of photographic processor 10. As shown in FIG. 2, photographic processor 10 includes opening 19 in side wall 13 for accessing chemical delivery system 16. Sliding track mechanism 20 allows an operator to pull at least a portion of chemical delivery system 16 through opening 19 to an exterior location outside of photographic processor 10. Such an assembly allows for quick and easy maintenance and replacement of chemical delivery system 16. Photographic processor 10 can include a waste collection reservoir 21, which collects and stores used processing chemicals removed from circular processing drum 14 following development of a given strip or roll of film. Optionally waste reservoir 21 can be an integral component of the chemical delivery system 16. As shown in FIG. 2, dryer 17 includes dryer entrance 171 and dryer blower 172. The various components of photographic processor 10 will be described in more detail below with reference to FIGS. 3–21.

Figure 3:
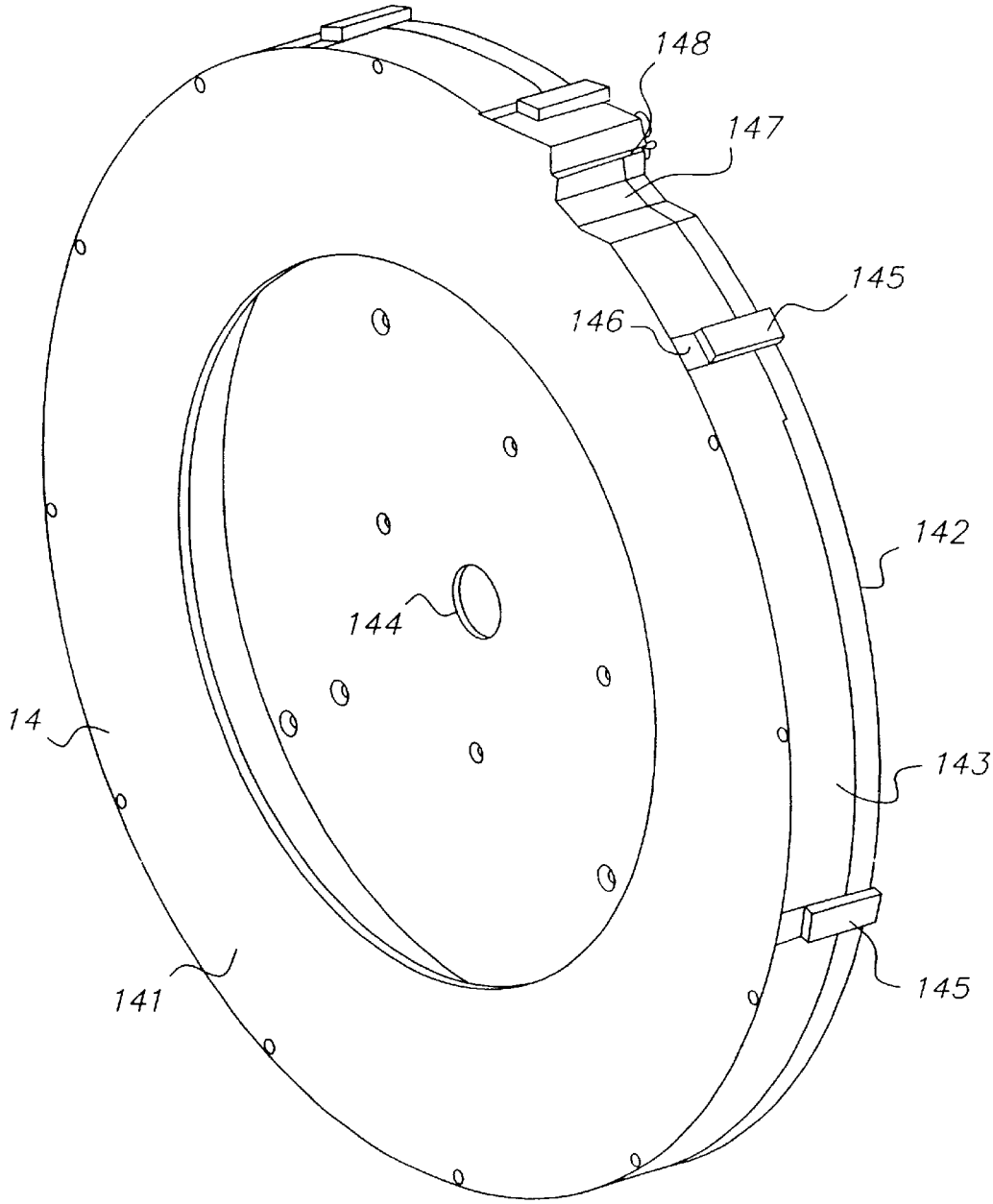
FIG. 3 depicts an exemplary circular processing drum used in the photographic processor of the present invention.

Circular processing drum 14 is further described in FIG. 3. As shown in FIG. 3, circular processing drum 14 includes a first or front wall 141, a second or back wall 142, a side wall 143, and a central axis opening 144. A portion of a drum and disk drive mechanism 25 (shown in FIGS. 2, 8 and 9) passes through central access opening 144. Circular processing drum 14 comprises two circular sections joined together at multiple locations around the perimeter of circular processing drum 14 via male clasping members 145 and female clasping members 146. It should be noted that any means for attaching the two circular components of circular processing drum 14 may be used in place of male clasping members 145 and female clasping members 146. Further, it should be noted that circular processing drum 14 may be a single component as opposed to two circular components as shown in FIG. 3, although such a design may add manufacturing cost to circular processing drum 14. Circular processing drum 14 further comprises a film cartridge loading area 147 on an outer surface of side wall 143 for loading film directly from a film cartridge into circular processing drum 14, such as with APS film. Circular processing drum 14 also comprises a film input slot 148, which enables the entry and exit of film into circular processing drum 14.

Figure 4:
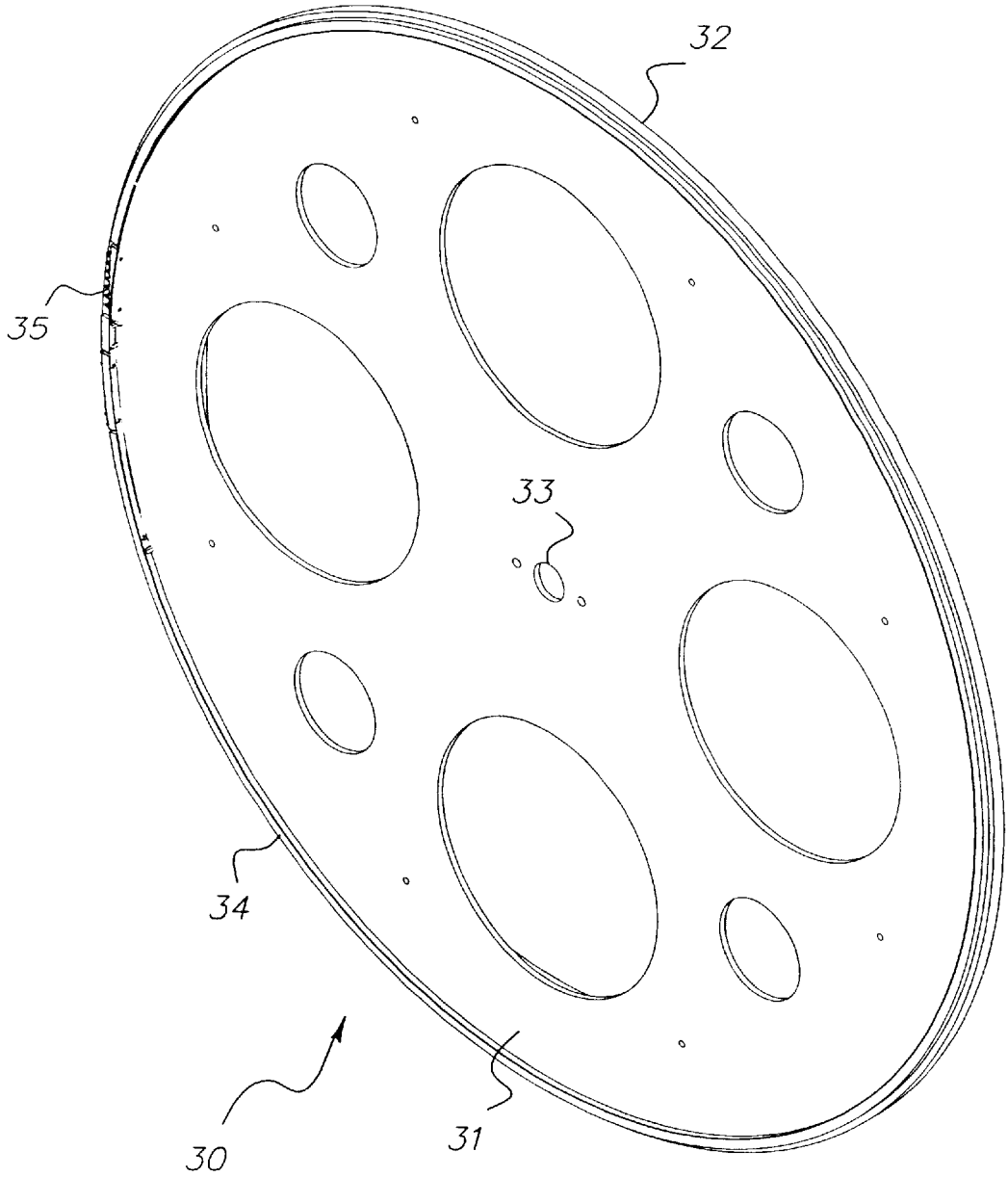
FIG. 4 depicts an exemplary disk located within the circular processing drum of the present invention.
Figure 5:
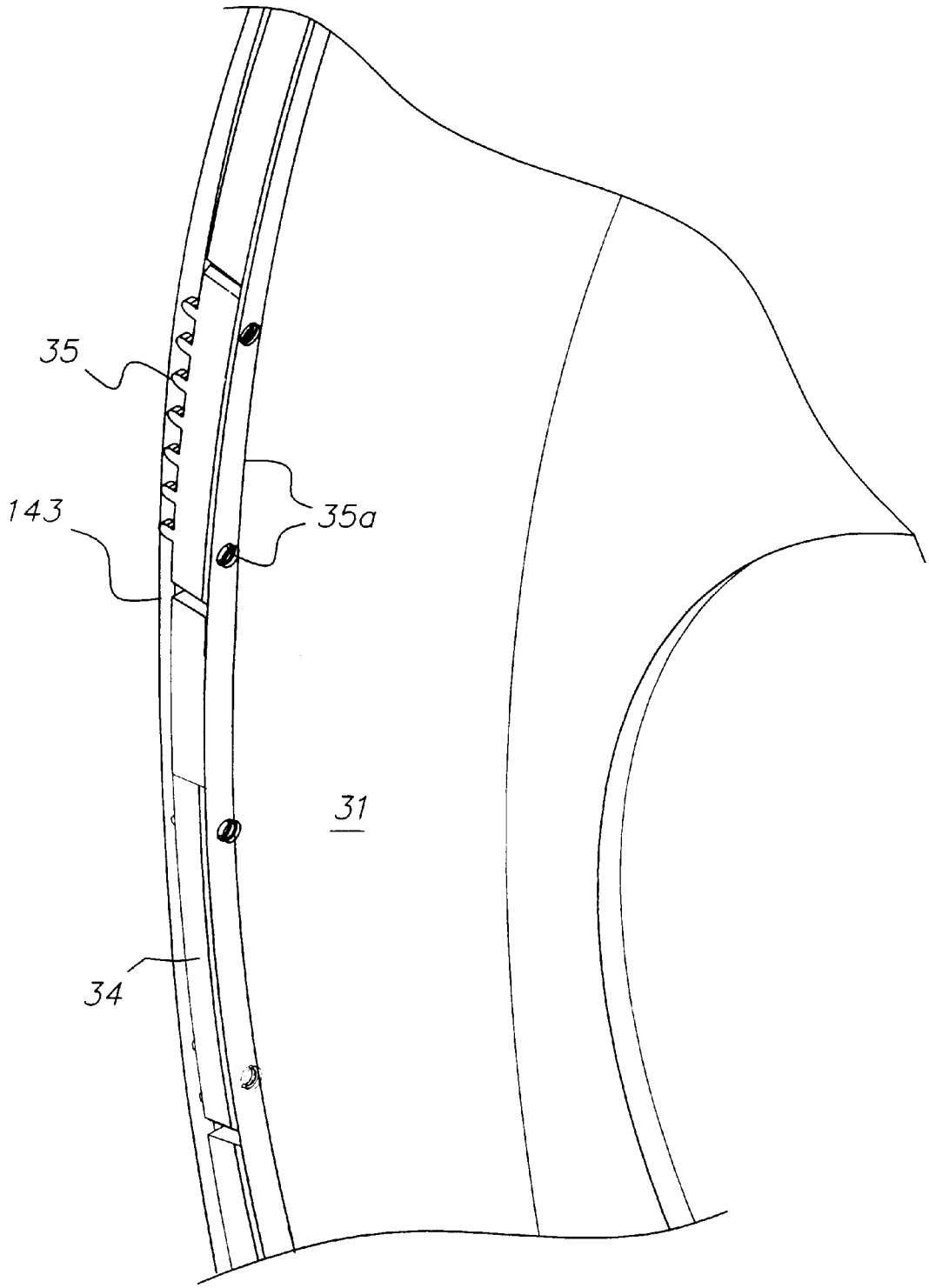
FIG. 5 displays a close-up view of an exemplary disk having an outer perimeter and one or more sets of disk teeth.
Figure 6:
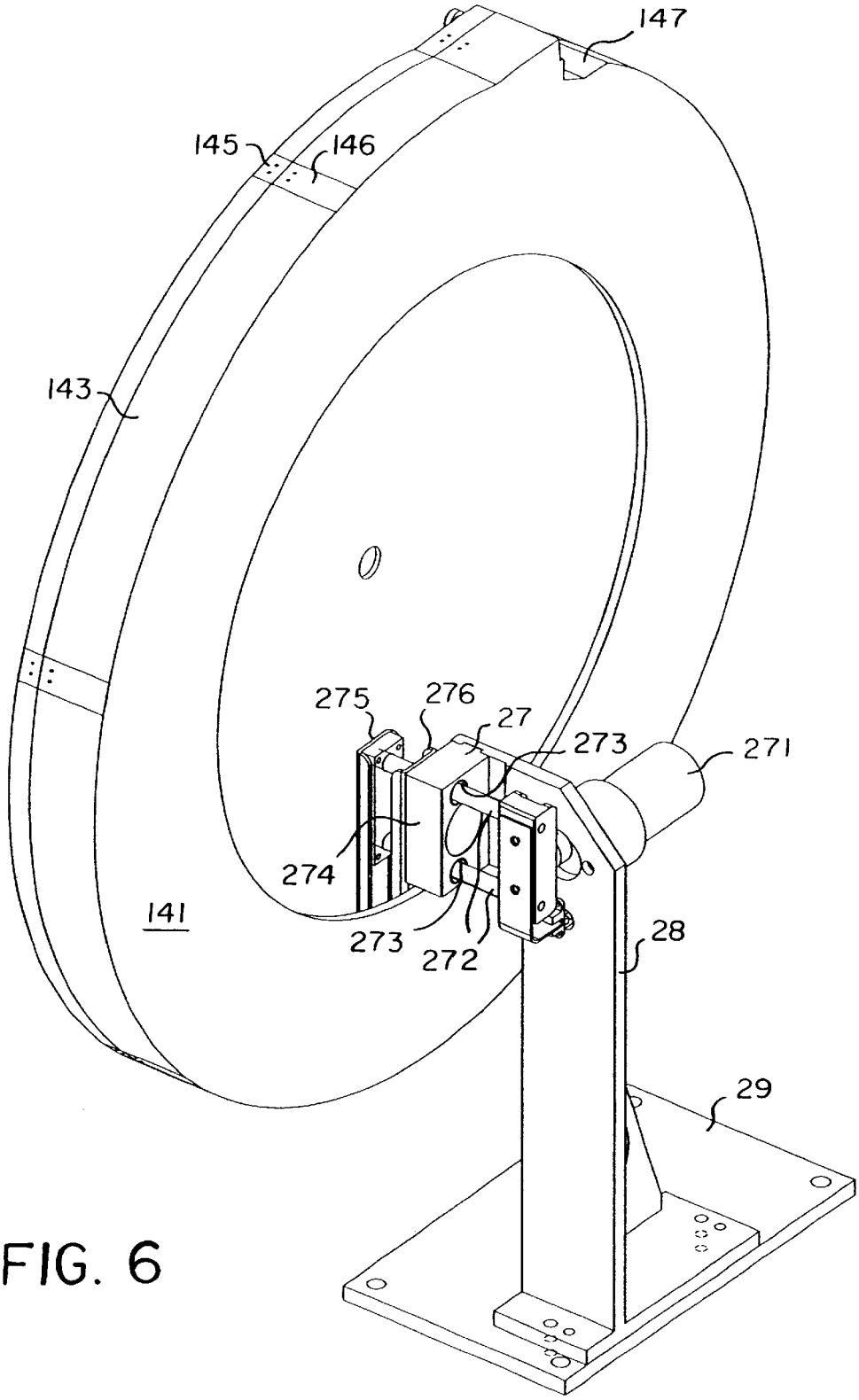
FIG. 6 depicts an exemplary roller mechanism positioned within the circular processing drum.

FIG. 4 depicts an exemplary disk 30, which is positioned within circular processing drum 14, and functions to convey film within circular processing drum 14 once the film enters through film input slot 148. Disk 30 includes a first face 31, a second face 32, a central access opening 33, an outer perimeter 34, and one or more sets of disk teeth 35 located along outer perimeter 34 of disk 30. As with circular processing drum 14, a portion of drum and disk drive mechanism 25 may extend into central access opening 33 to engage with and cause rotation of disk 30. FIG. 5 provides a close-up view of a portion of disk 30, and in particular, outer perimeter 34 and a set of disk teeth 35 on the outer perimeter 34 of disk 30. The outermost points of disk teeth 35 are in close proximity to an inner surface of side wall 143 of circular processing drum 14. In a feature of the invention, disk teeth 35 could be spring loaded through the use of spring arrangement 35*a*.

Figure 7:
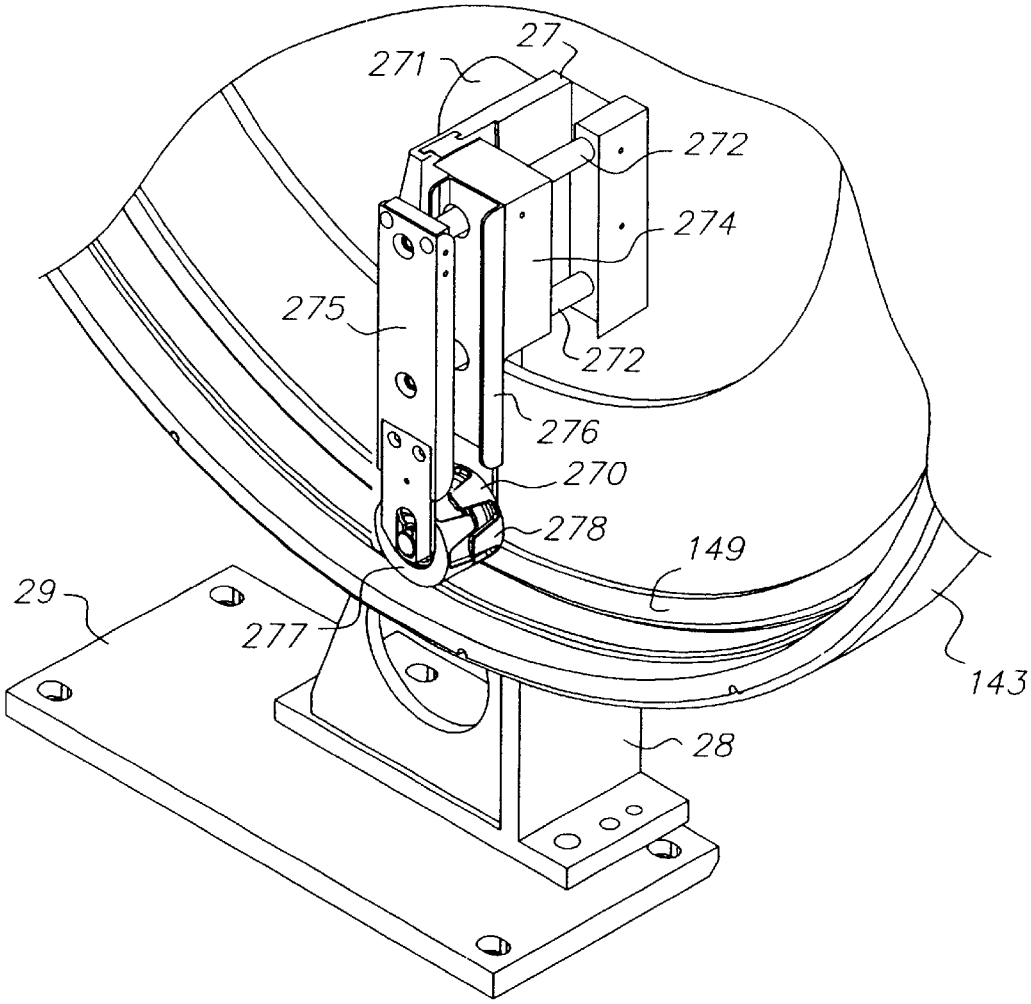
FIG. 7 depicts a rear view of the exemplary roller mechanism of FIG. 6.

A roller arrangement 27 (FIGS. 6 and 7) is positioned within circular processing drum 14. Roller arrangement 27 includes a roller 270 having interengaging members 277 and 278 (FIG. 7). Roller arrangement 27 may be supported by a support member 28, which is attached to a support member base 29. Support member base. 29 may be permanently or temporarily attached to base housing member 12 (shown in FIGS. 1 and 2). Roller arrangement 27 includes a motor 271, which provides motion to pistons 272 through openings 273 in a fixed positioning member 274. Pistons 272 proceed through stationary positioning support member 276 and are attached to movable positioning support member 275. As pistons 272 move, movable positioning support member 275 which is coupled to member 277 separates from stationary positioning support member 276 which is coupled to member 278. This permits roller 270 to be expandible between a first width when the members 277 and 278 overlap each other and a second width larger than the first width (FIG. 7) when the members 277 and 278 move away from each other.

FIG. 7 provides a detailed view of roller arrangement 27 and its various components. As shown in FIG. 7, movable positioning support member 275 and stationary positioning support member 276 connect to interengaging members 277 and 278 respectively as described above. During use, the film passes between roller 270 and an interior surface of drum 14. Roller 270 is freely rotatable and maintains the film flat along the lower portion of drum 14. As will be described later, roller 270 further provides an agitating feature within processing drum 14 during processing. Additionally, the width of roller 270 is adjustable as described above to accommodate a shorter width film (i.e. APS film) and a larger width film (i.e. 35 mm film). Further, roller arrangement 27 including roller 270 can be vertically adjustable to accommodate for film curl as the film passes between roller 270 and the interior surface of drum 14. As a still further option, roller 270 can be spring loaded so as to accommodate any variation in the interior surface of drum 14.

Figure 8:
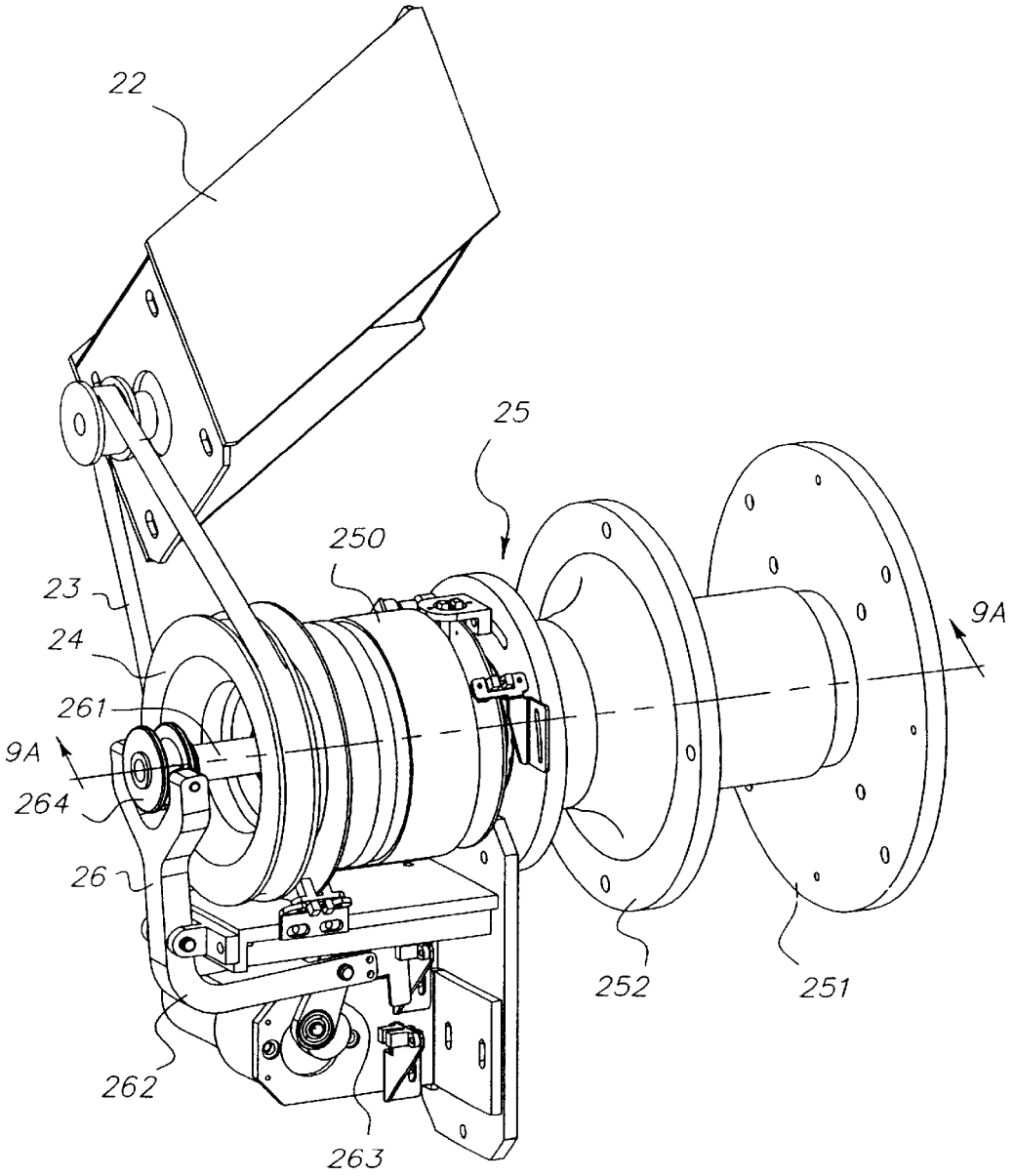
FIG. 8 depicts an exemplary drum and disk drive mechanism for rotating a circular processing drum, and a clutch mechanism for selectively engaging the drum and disk.
Figure 9A:
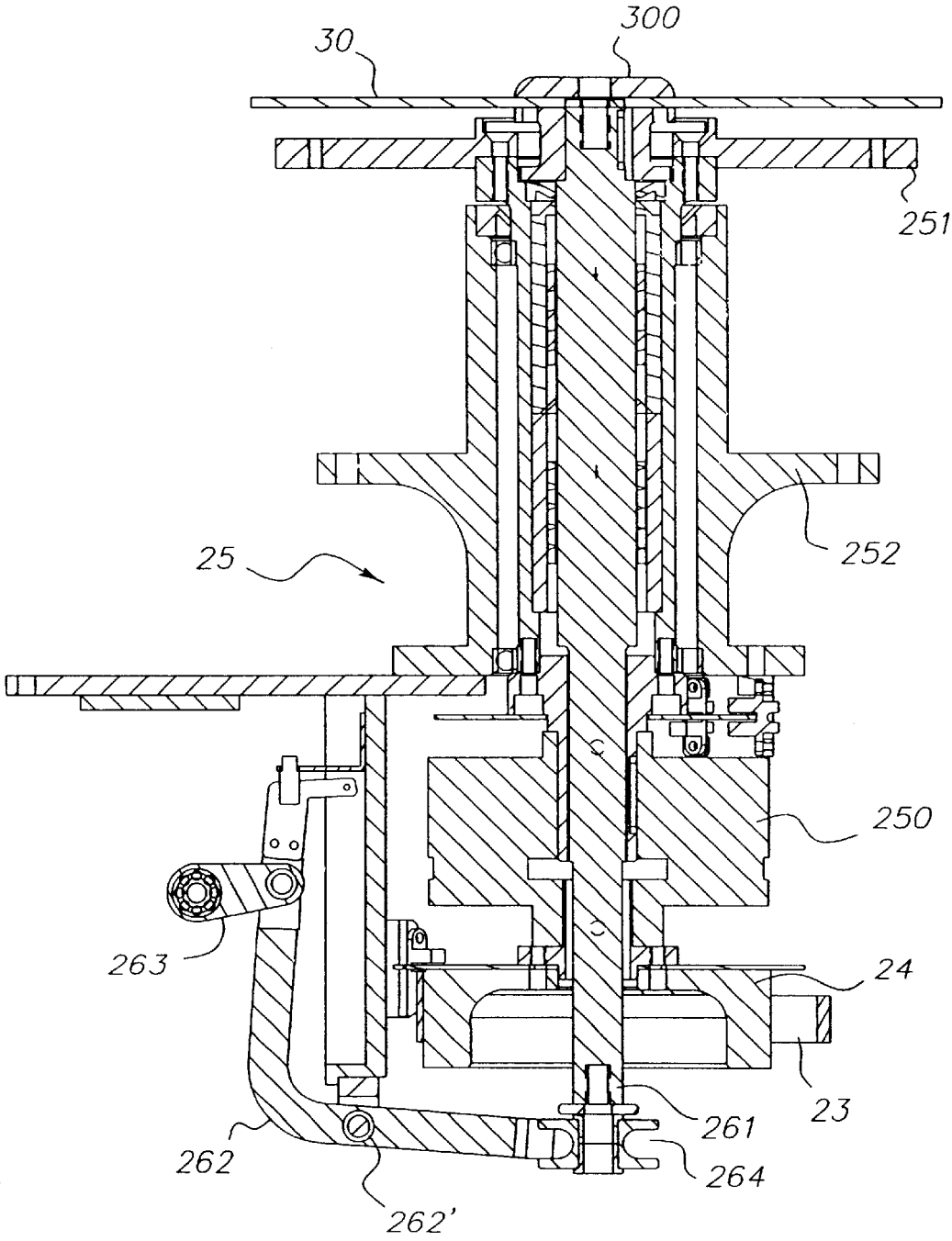
FIG. 9A displays a cross-sectional view of the drum and disk drive mechanism along line 9A—9A in FIG. 8.

Circular processing drum 14 is connected to a drum and disk drive mechanism 25, which selectively rotates disk 30 relative to drum 14 to position and convey the film along and within processing drum 14, and rotates both disk 30 and drum 14 together during a processing cycle. Circular processing drum 14 rotates about an axis of symmetry. An exemplary drum and disk drive mechanism 25 is shown in FIG. 8. Drum and disk drive mechanism 25 cooperates with a motor 22, a belt 23, and a pulley 24 as shown in FIGS. 8 and 9A. Drum and disk drive mechanism 25 includes a drive shaft 261 which is operationally connected to pulley 24. Also shown in FIGS. 8 and 9A are flanges 251 and 252. Flange 251 is connected to drum 14 while an end cap 300 holds disk 30 for rotation about drive shaft 261 (FIG. 9A). Actuation of motor 22 drives belt 23 which in turn drives pulley 24. This in turn causes a rotation of drive shaft 261 which rotates disk 30. Clutch mechanism 250 enables the engagement and disengagement of flange 251 to provide selective rotation to circular processing drum 14.

Figure 9B:
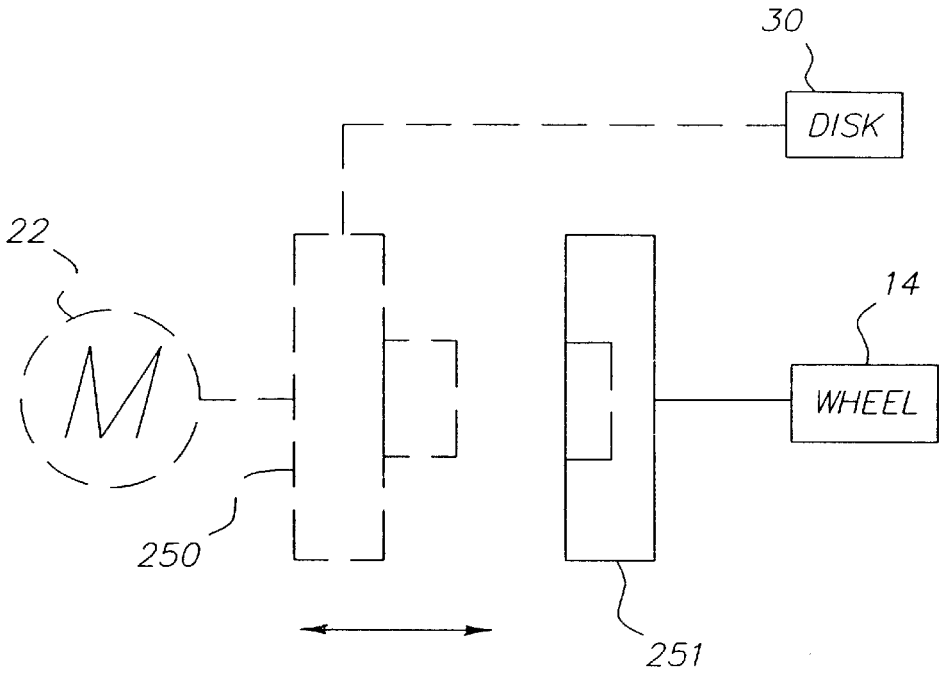
FIG. 9B schematically illustrates a driving and clutching arrangement of the invention.

FIG. 9A displays a cross-sectional view of drum and disk drive mechanism 25 and clutch mechanism 250 along line 9A–9A in FIG. 8. With reference to FIG. 9A and FIG. 9B which is a schematic representation of the driving and clutching feature of the present invention, an operation will now be described. When loading film which will be described with reference to FIGS. 10 and 11, clutch 250 is deactivated as shown in FIG. 9B. In this state, rotation of motor 22 will cause a rotation of drive shaft 261 and accordingly, a rotation of disk 30 relative to drum 14. This is due to the fact that clutch 250 is deactivated and therefore, drum 14 is not rotated. This permits the conveyance of the film by rotation of disk 30 to a desired location within drum 14. After the film reaches the desired location within drum 14, clutch 250 is activated, (for example, clutch 250 is moved to the right in FIG. 9B) by actuating clutch 250 with flange 251 which is attached to drum 14. Therefore, a rotation of motor 22 will cause a rotation of both disk 30 and drum 14. This occurs during the processing stages to process the film in a manner which will be described later.

Drive shaft 261 can be moved perpendicularly and through flange 251 and flange 252 to move disk 30 attached thereto. As shown in FIG. 9A, drive shaft 261 is attached to a fitting 264 in a manner which permits drive shaft 261 to rotate relative to fitting 264. Fitting 264 is in turn rotatably attached to a pivotable arm 262 and a movable member 263. Movable member 263 can be operationally connected to a motor for rotation of member 263. This causes arm 262 to pivot about point 262' to move drive shaft 261 to the left or right when viewing FIG. 9A from above the page. Movement of drive shaft 261 as noted above, moves disk 30 in a directionparallel to an axis of disk 30. This facilitates the accommodation of, for example, 35 mm and APS film on disk 30, since the disk 30 can be moved based on the type of film being processed.

Figure 10:
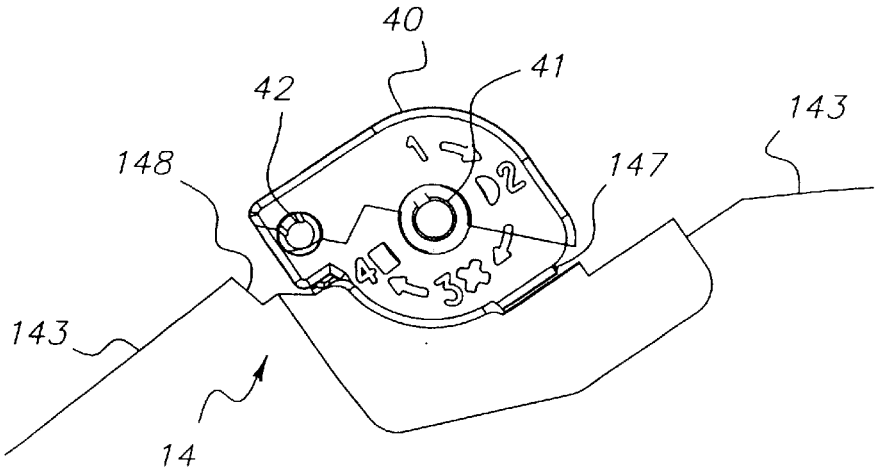
FIG. 10 depicts a film cartridge in a film-loading position using one film-loading method of the present invention.

Within the context of the present invention, a film may be loaded into circular processing drum 14 by a number of methods. One method of loading film, such as APS film, into circular processing drum 14 is shown in FIGS. 10–13. As shown in FIG. 10, film cartridge 40 comprising a film cartridge spool 41 and film cartridge door opening mechanism 52 is positioned in a film cartridge loading area 147 located on side wall 143 of circular processing drum 14. Film (not shown) exiting film cartridge 40 enters circular processing drum 14 at light tight film input slot 148 (FIG. 3) in side wall 143 of circular processing drum 14.

Figure 11:
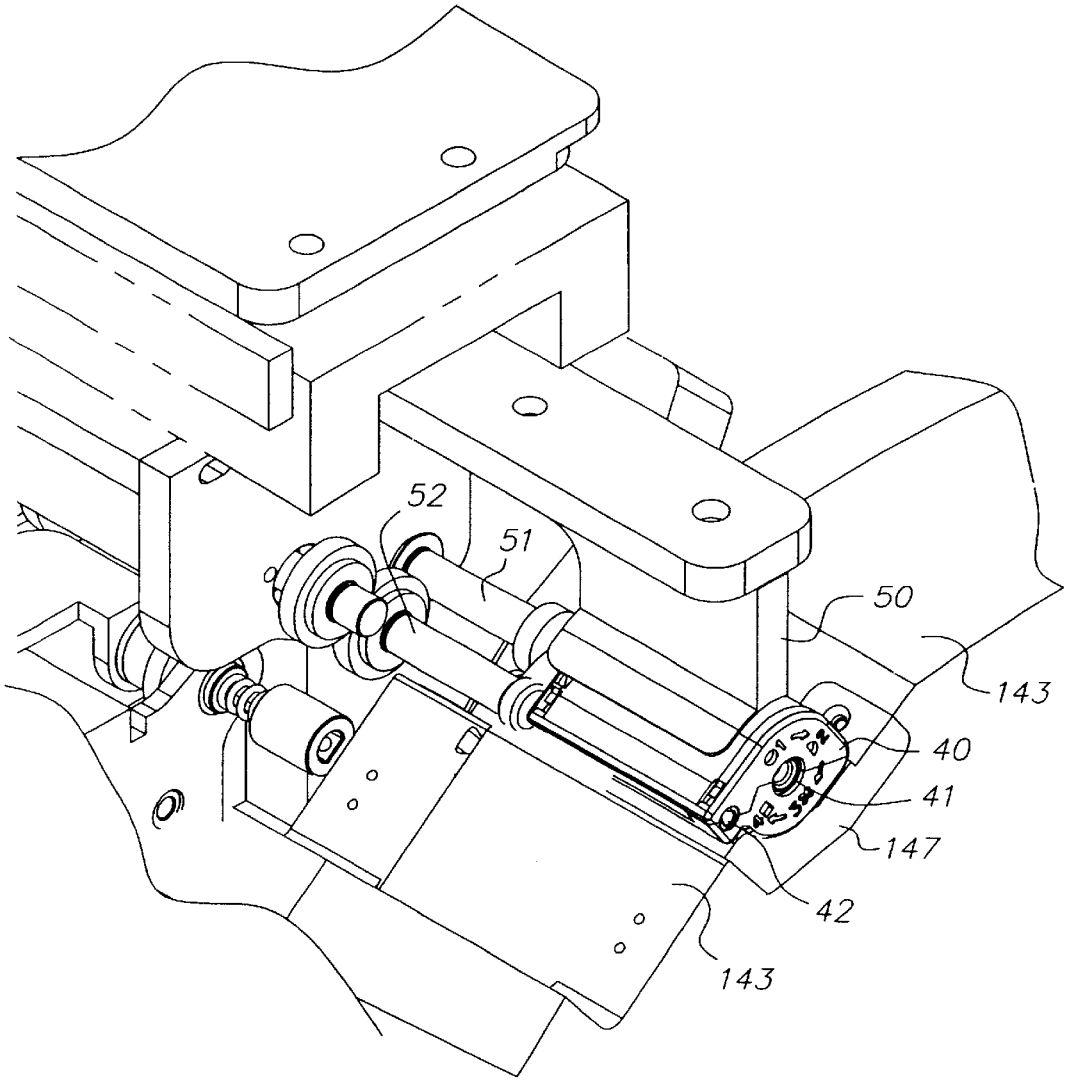
FIG. 11 depicts a film cartridge stabilizing step in one film-loading method of the present invention.

Once film cartridge 40 is positioned in film cartridge loading area 147, the photographic processor 10 of the present invention initiates a number of film-loading and conveying steps, the results of which are shown in FIG. 11. It is noted that the film loading and conveying steps as well as other processing steps can be controlled by a computer or central processing unit 2000 (FIG. 1) operationally associated with processor 10. In a first step, a film cartridge stabilizing member 50 applies an amount of pressure onto an upper surface of film cartridge 40 to prevent film cartridge 40 from moving while positioned in film cartridge loading area 147. Spool engaging member 51 and cartridge door opening mechanism engaging member 52 move toward film cartridge 40 and engage with film cartridge spool 41 and film cartridge door 42, respectively. Door opening mechanism engaging member 52 opens film cartridge mechanism 42 and spool engaging member 51 begins to rotate film cartridge spool 41, forcing film (not shown) out of film cartridge 40.

Figure 12:
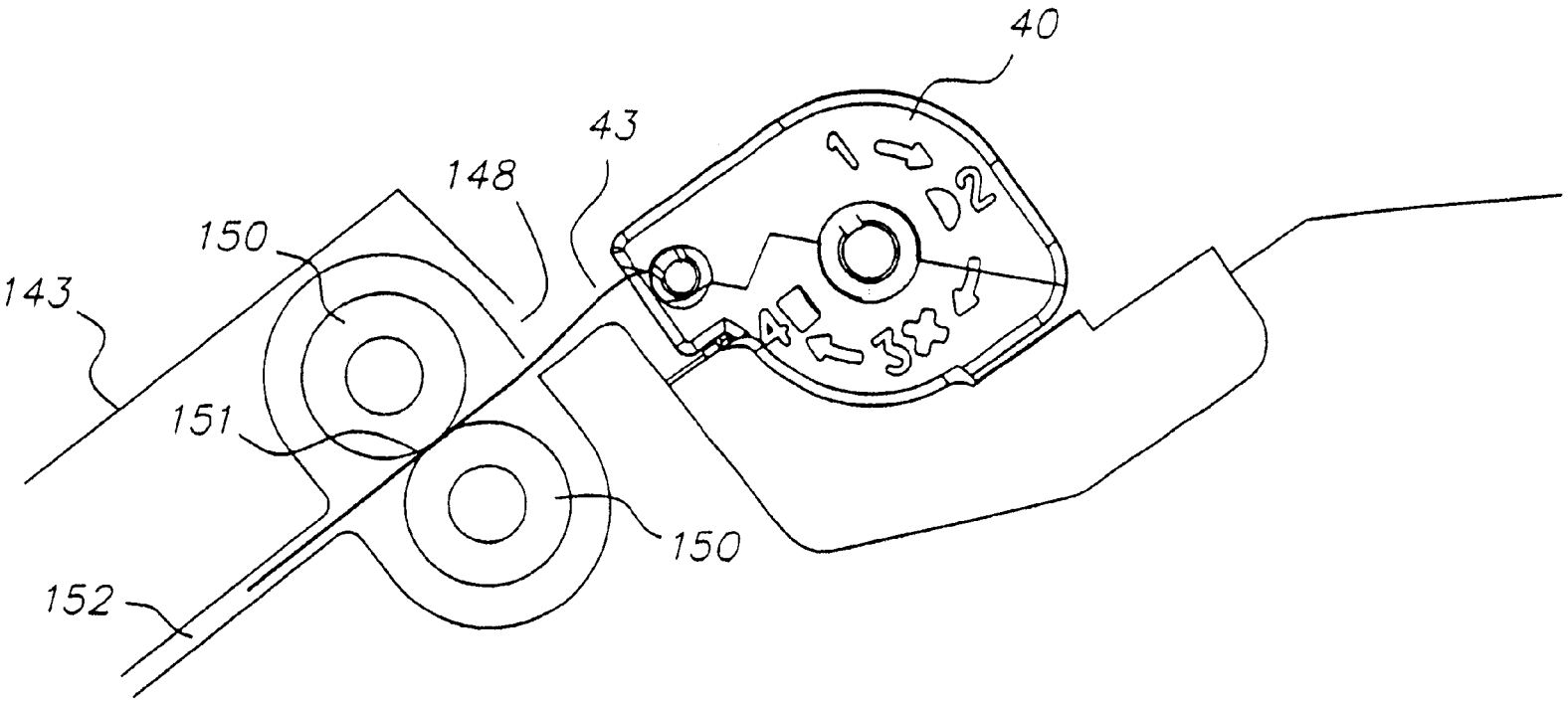
FIG. 12 depicts a film nipping step during a film-loading method of the present invention.
Figure 13:
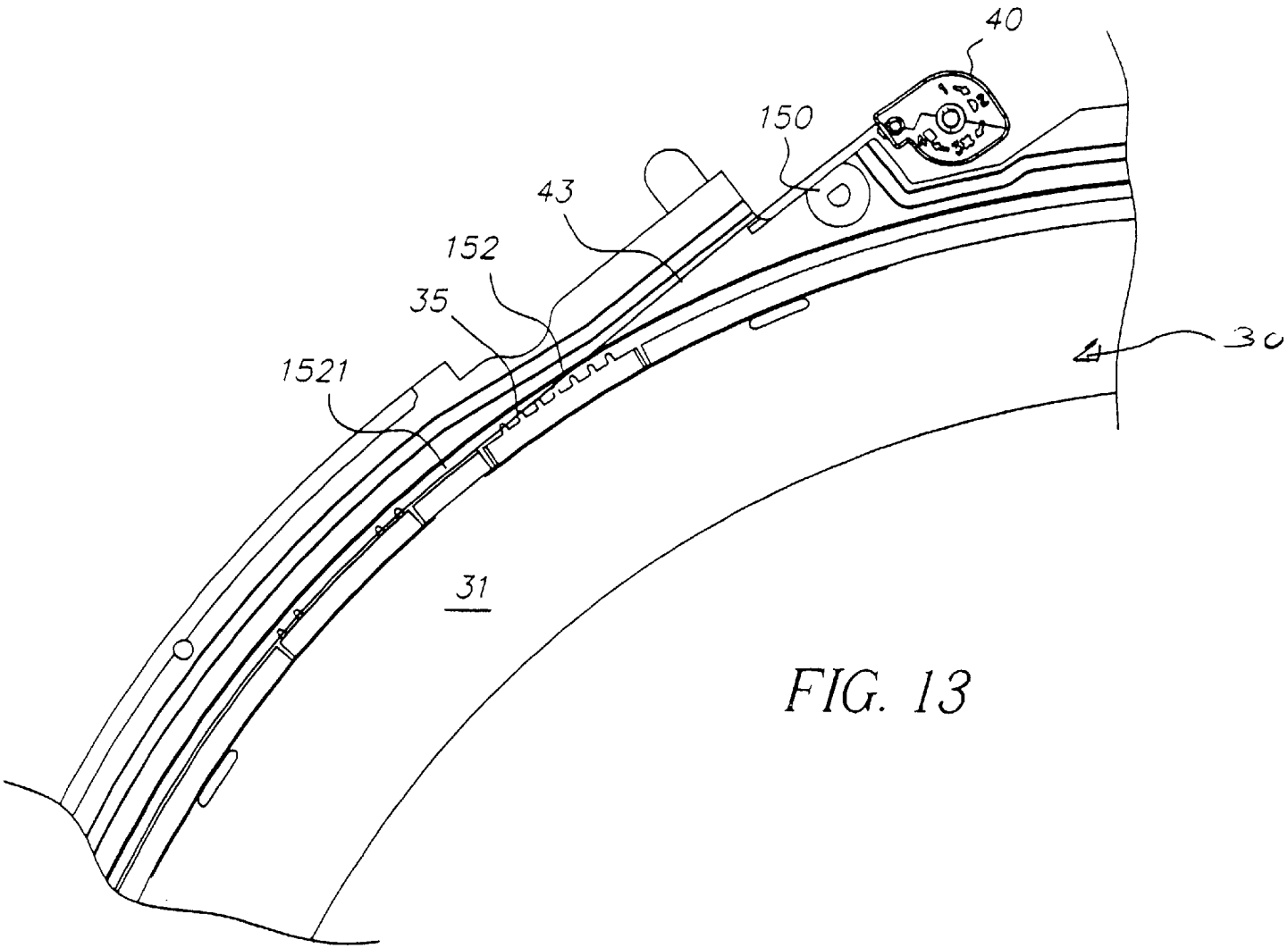
FIG. 13 depicts a cross-sectional view of film entering into a circular processing drum in one film-loading method of the present invention.

FIG. 12 shows a strip of film 43 exiting film cartridge 40 and entering film input slot 148 of circular processing drum 14. Driven nip rollers 150 grasp a leading edge of the strip of film 43 at drum roller nip point 151 and advance film 43 further into circular processing drum 14. As shown in FIG. 13, the strip of film 43 exits drum cavity slot 152 and enters into the drum processing cavity 1521 of circular processing drum 14, wherein one or more sets of disk teeth 35 on disk 30 interengage with holes or perforations along an edge of the strip of film 43. As previously described, disk teeth 35 could be spring loaded so as to spring up at the appropriate time and interengage with the holes or perforations along film 43. With clutch 250 disengaged, disk 30 and rollers 150 are rotated while circular processing drum 14 remains stationary. This causes film 43 to advance into the processing cavity 1521 of circular processing drum 14 a desired distance equal to the length of the strip or roll of film 43. As shown in FIGS. 10–13, in this film-loading method of the present invention, the film 43 remains intact with film cartridge 40.

A number of commercially available films may be loaded according to the film-loading method described above, namely, wherein the film remains intact with its corresponding film cartridge during processing. A suitable film, which may be used in this particular film-loading method, includes, but is not limited to, APS film. Desirably, APS film is loaded into the photographic processor of the present invention according to this method.

Figure 14:
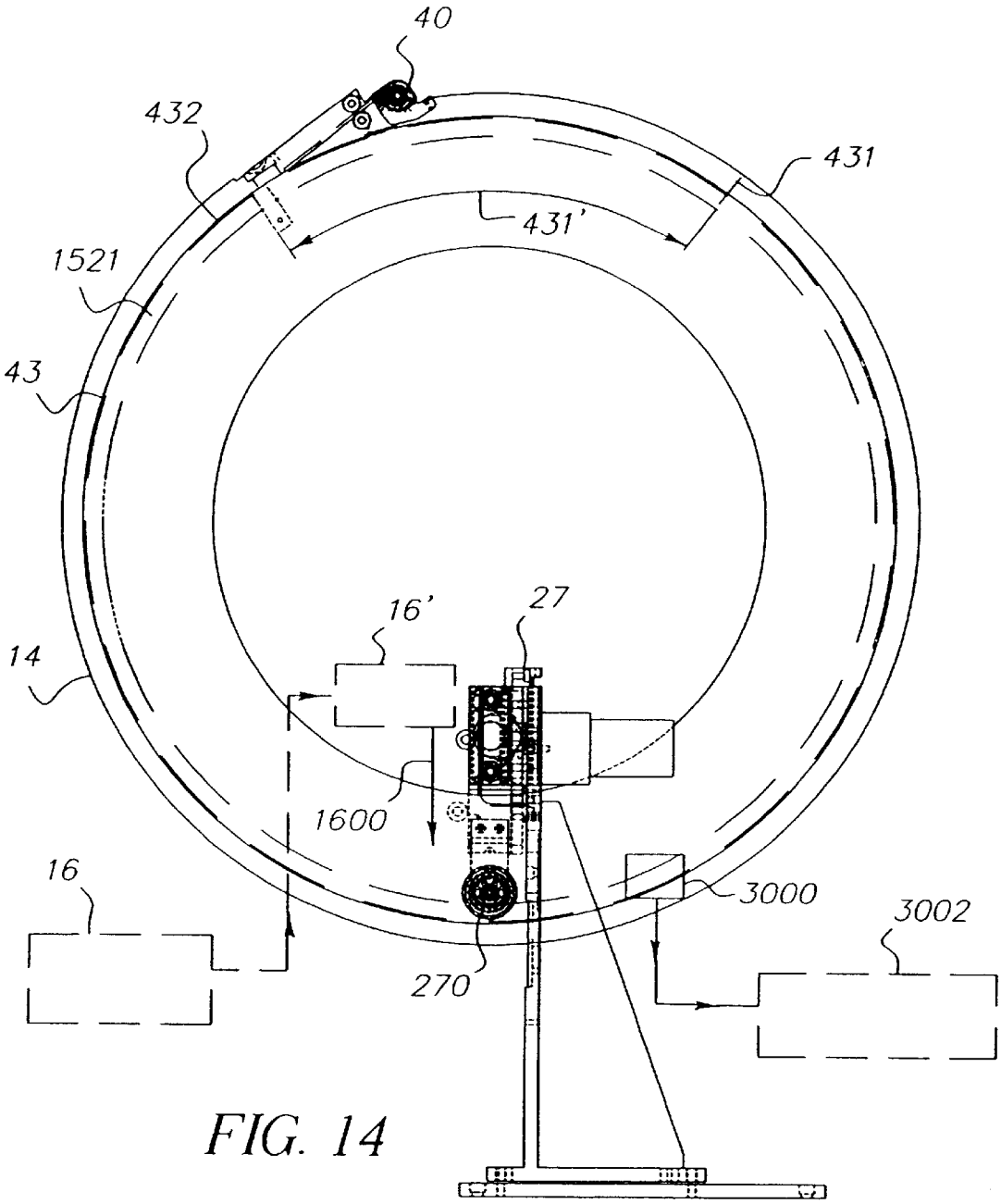
FIG. 14 depicts a sheet of film having a lead end and a tail end within the drum processing cavity of a circular processing drum.

FIG. 14 depicts circular processing drum 14 fully loaded with film 43 having a forward end 431 and a rearward end 432 within the drum processing cavity 1521 of circular processing drum 14. The back end of film 43 is maintained in cartridge 40. Film 43 is now positioned within circular processing drum 14 for chemical processing, wherein one or more processing fluids are deposited into circular processing drum 14 and placed in contact with film 43 for a desired period of time.

It is noted that the circumference of the drum will be longer than the length of the film to be processed. Therefore, when the film is loaded in drum 14, a section of drum 14 will not have film therein. This is referred to as a film-free zone 431' (FIG. 14). Prior to delivering chemistry by way of chemical supply 16 and a chemical delivery mechanisms 16' (FIG. 14), clutch 250 is activated or engaged and drum 14 is controllably rotated with disk 30 so that film-free zone 431' is at a lower end or below chemical delivery mechanism 16'. Chemical delivery mechanism 16' is preferably of the type which drops or delivers chemistry into drum 14 in the direction of arrow 1600 (FIG. 14). The movement of film-free zone to an area below chemical delivery mechanism 16' prior to the delivery of chemicals prevents the chemicals from being dropped directly on the film which could cause uneven processing. Thereafter, processing occurs by continuously rotating the drum 14 and disk 30. Further, as shown in FIG. 14, in the lower portion of drum 14, film 43 passes between wheel 270 and an inner surface of drum 14. Rotation of drum 14 and disk 30 relative to wheel 270 helps to agitate the processing fluid in the vicinity of wheel 270 to promote processing. Following the chemical processing steps, the film 43 is removed from circular processing drum 14 and exposed to a drying operation. One method of removing film 43 from circular processing drum 14 is shown in FIGS. 15A and 15B.

Figure 15A:
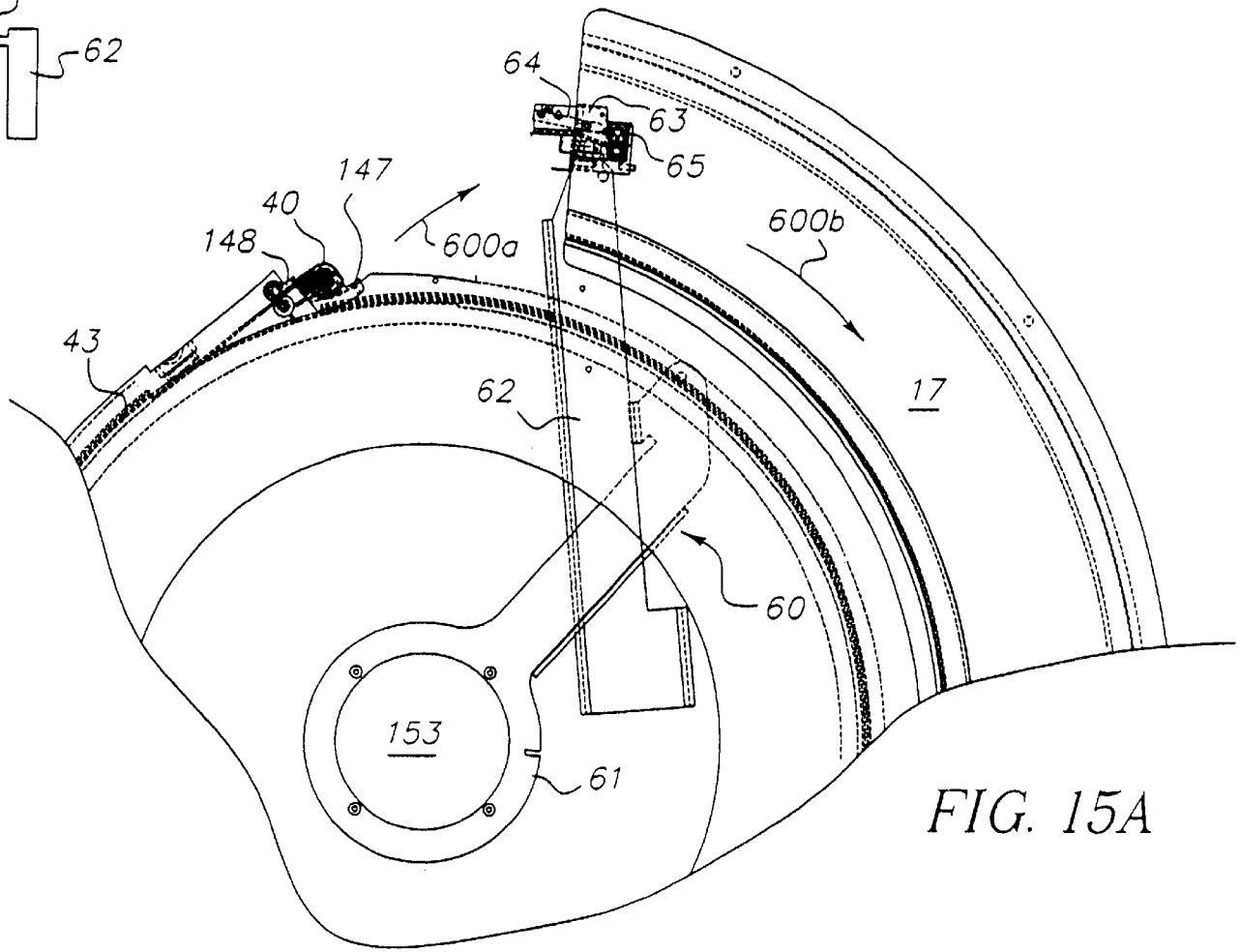
FIGS. 15A and 15B depicts an exemplary film transfer arm, which transfers film from a circular processing drum to a dryer.
Figure 15B:
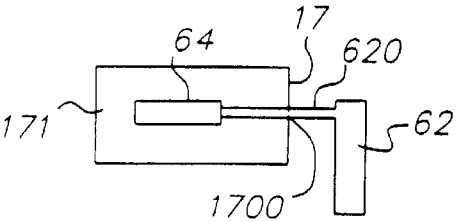

As shown in FIG. 15A, film transfer arm assembly 60 is positioned to move or pivot between circular processing drum 14 and dryer 17. Film transfer arm assembly 60 includes a lower arm member 61, which is rotatable around an axis of symmetry 153 of circular processing drum 14. Film transfer arm assembly 60 also includes an upper arm member 62, which is pivotally attached to lower arm member 61. At upper arm member end 63, film transfer arm assembly 60 includes a film cartridge gripper 64 and film strip gripper rolls 65. As shown in FIG. 15B, which is a front view of the entrance of dryer 17, a side wall of dryer 17 includes a slot 1700 with a rubber seal that extends along the length of the dryer.

Upper arm member 62 includes a shaft 620 which extends from upper arm member 62, through slot 1700 and is connected to gripper 64. This permits transfer arm assembly 60 to pull gripper 64 and thus the film to be dried though the dryer.

In embodiments wherein the film 43 remains intact with film cartridge 40 (as described above), film cartridge gripper 64 of film transfer arm assembly 60 engages with film cartridge 40, pulls film cartridge 40 from loading area 147 and the strip of film 43 from circular processing drum 14 in direction 600*a*, and proceeds through dryer 17 in direction 600*b*. Therefore, cartridge 40 with processed film 43 attached and trailing therefrom is conveyed through dryer 17 to dry film 43 by, for example, the blowing of air into dryer 17. In other embodiments where the film 43 is detached from film cartridge 40 (described below), film sheet gripper rolls 65 grip an edge of film 43 as film 43 exits film input slot 148 of circular processing drum 14. Film sheet gripper rolls 65 of film transfer arm assembly 60 pull film 43 from circular processing drum 14 and proceeds through dryer 17. Once dried, film 43 is re-wound back into its cartridge 40 prior to proceeding to scanner 18'.

Figure 16:
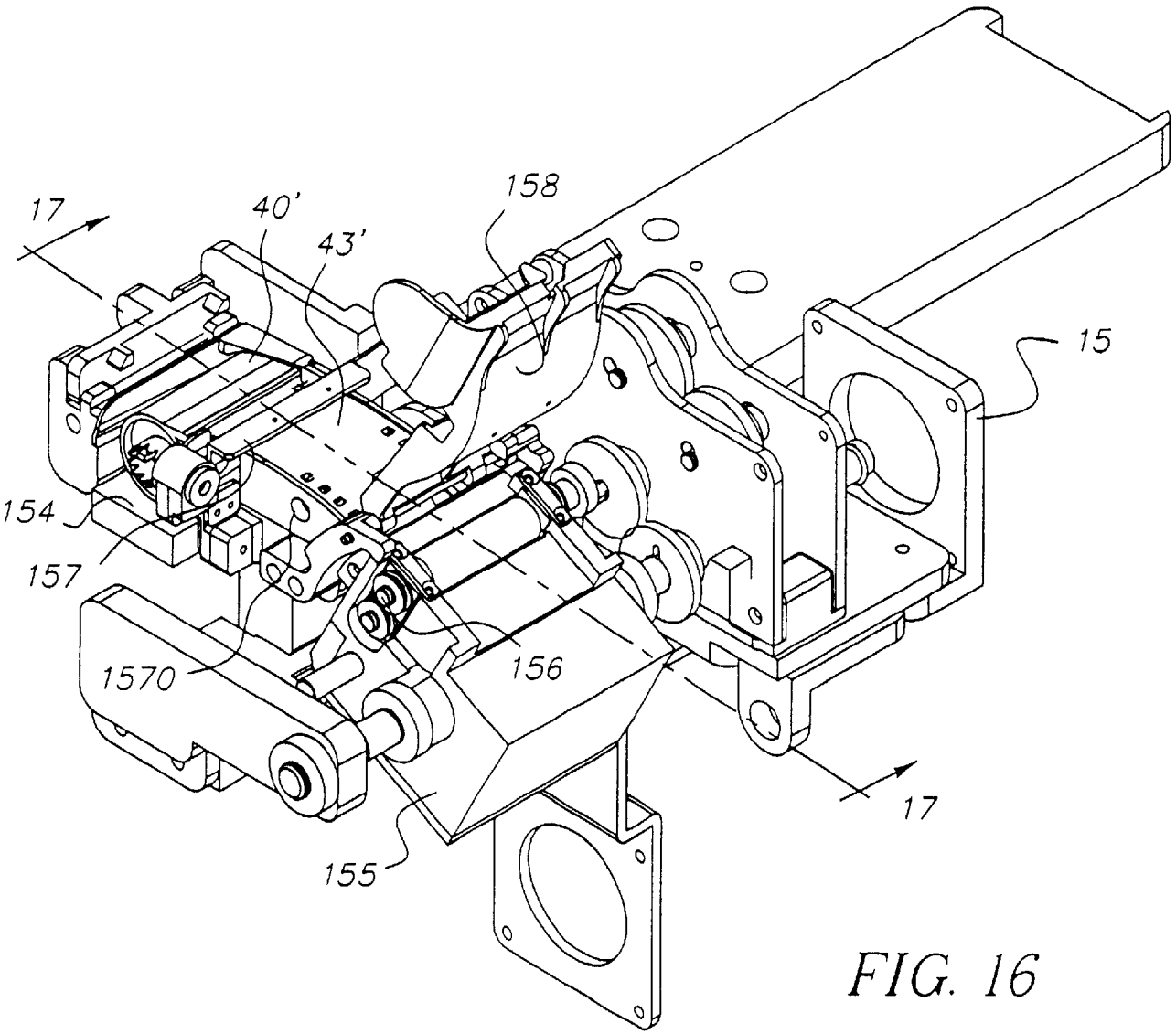
FIG. 16 depicts an exemplary film loading/unloading device used in a film-loading method of the present invention wherein film is separated from its corresponding film cartridge.

In a further film-loading method, the film is separated from its film cartridge prior to processing within circular processing drum 14 (for example, 35 mm film). In this method, a film loading/unloading device, such as exemplary film loading/unloading device 15 as shown in FIG. 16, may be used. Film loading/unloading device 15 includes a film cartridge loading area 154, which can be enclosed by closing a door 158. In film loading area 154, an operator extracts the tongue of film 43' from cartridge 40' and engages the perforations on film 43' with sprockets on a driven roller 1570. Thereafter door 158 is closed and film 43' proceeds into festoon box 155 through festoon box nip rollers 156. Once a desired length of film is removed from film cartridge 40', a cutter 157 slices film 43' to separate film 43' from film cartridge 40'. Any counter device (not shown) may be used to measure the length of the strip of film 43' passing through festoon box nip rollers 156. The length measurement is used in further processing steps as described below.

Figure 17:
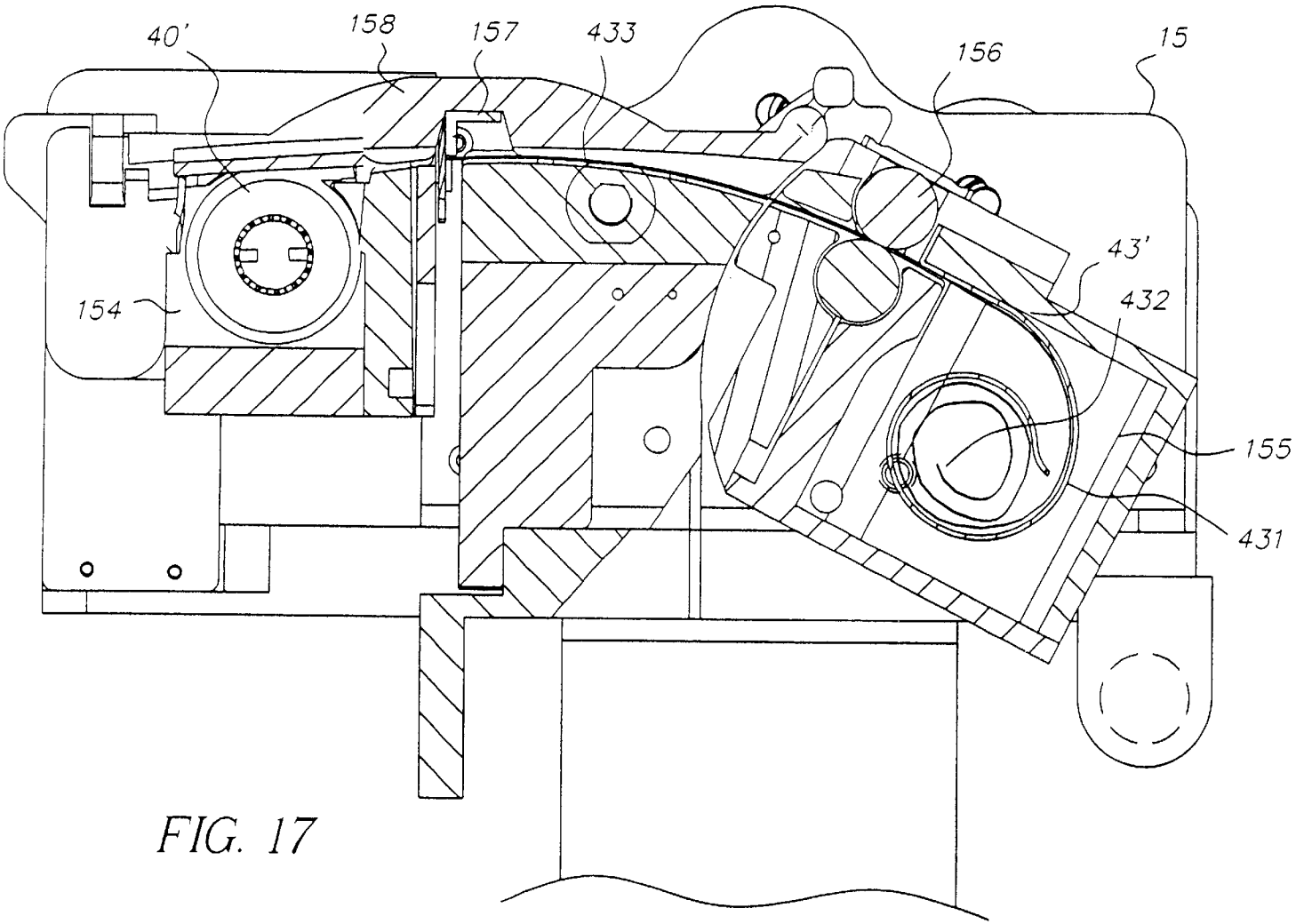
FIG. 17 depicts a cross-sectional view of the exemplary film loading/unloading device as seen along line 17—17 in FIG. 16.

FIG. 17 depicts a cross-sectional view of film loading/unloading device 15 as seen along line 17—17 in FIG. 16. As shown in FIG. 17, film cartridge 40' is positioned in film cartridge loading area 154 while a strip of film 43' is removed from film cartridge 40' and transported to festoon box 155 where it is turned. In this film-loading operation, a reverse roll of film 431 is formed from the film 43' in festoon box 155. A lead end of film 432 becomes the innermost portion of the reverse roll 431 while a tail end of film 433 becomes the outermost portion of reversed roll 431. When the film 43' is subsequently fed into circular processing drum 14 (as previously described), tail end 433, which contains the last exposures on the strip of film 43', is fed into circular processing drum 14 first.

Figure 18:
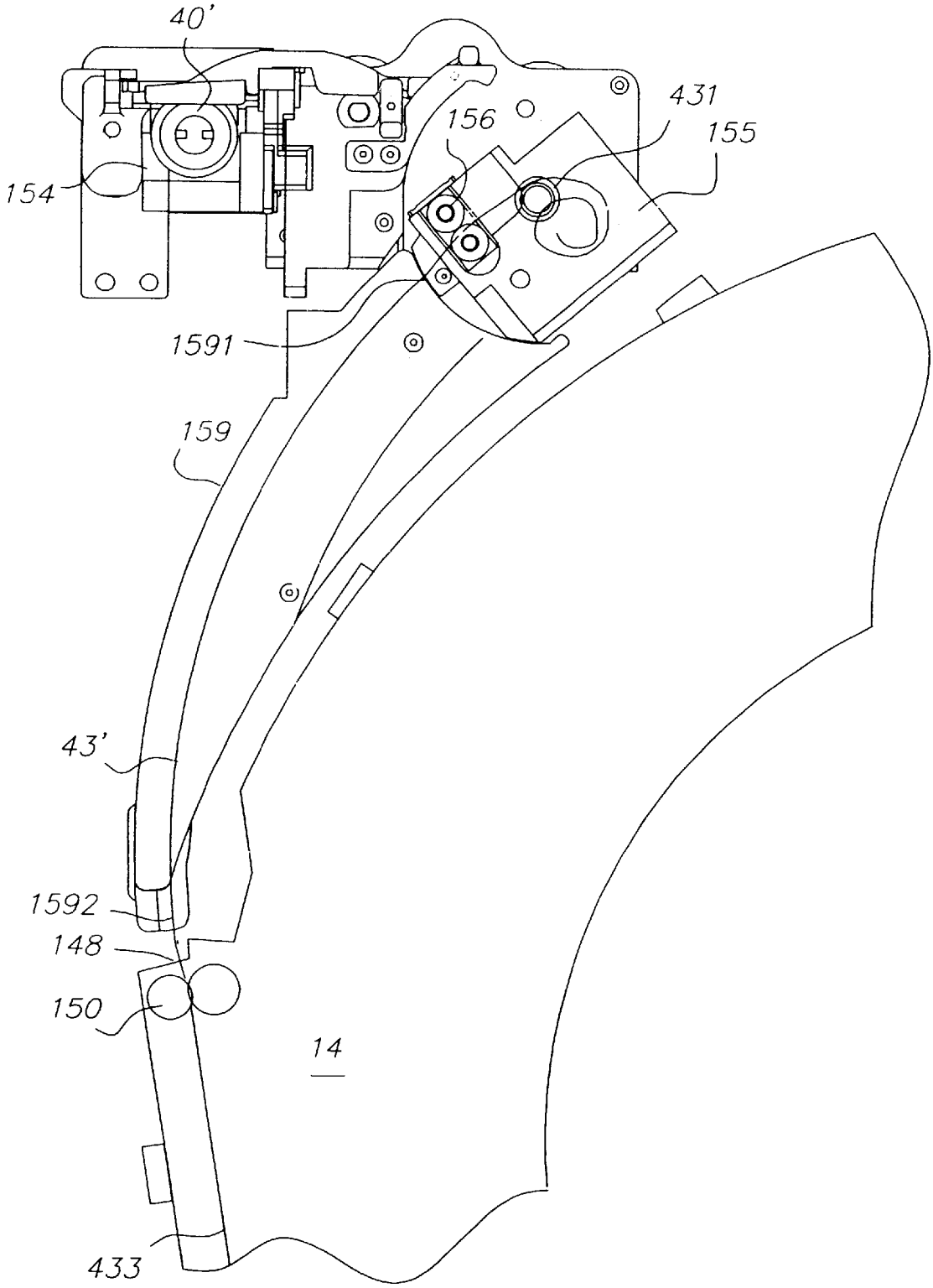
FIG. 18 depicts an exemplary film-loading guide used to load a film roll into a circular processing drum.

A film-loading guide 159 is used to load reverse roll 431 into circular processing drum 14 as shown in FIG. 18. Festoon box 155 rotates from an initial position (as shown in FIGS. 16 and 17) to a film-loading position as shown in FIG. 18. Festoon box nip rollers 156 turn to advance tail end 433 of reverse roll 431 into film-loading guide 159 at guide entrance slot 1591. The film 43' exits the film-loading guide 159 at guide exit slot 1592 positioned adjacent to film input slot 148 of circular processing drum 14. Once the tail end 433 of the strip of film 43' enters into circular processing drum 14, driven nip rollers 150 grab the film 43' and advance the film 43' into circular processing drum 14 as described above. It should be noted that in this film-loading method, nip rollers 150 are programmed to advance the film 43' into circular processing drum 14 a specific length, which corresponds to the length of film inputted into festoon box 155 and measured via festoon box nip rollers 156 as described above. In other words, nip rollers 150 advance the strip of film 43' into circular processing drum 14 so that lead end 432 of film 43' remains nipped between nip rollers 150 during chemical processing (i.e., lead end 432 of the strip of film 43' does not enter into drum processing cavity 1521). This permits all of the exposed areas of the film 43' to be in the processing area in the drum.

Figure 19:
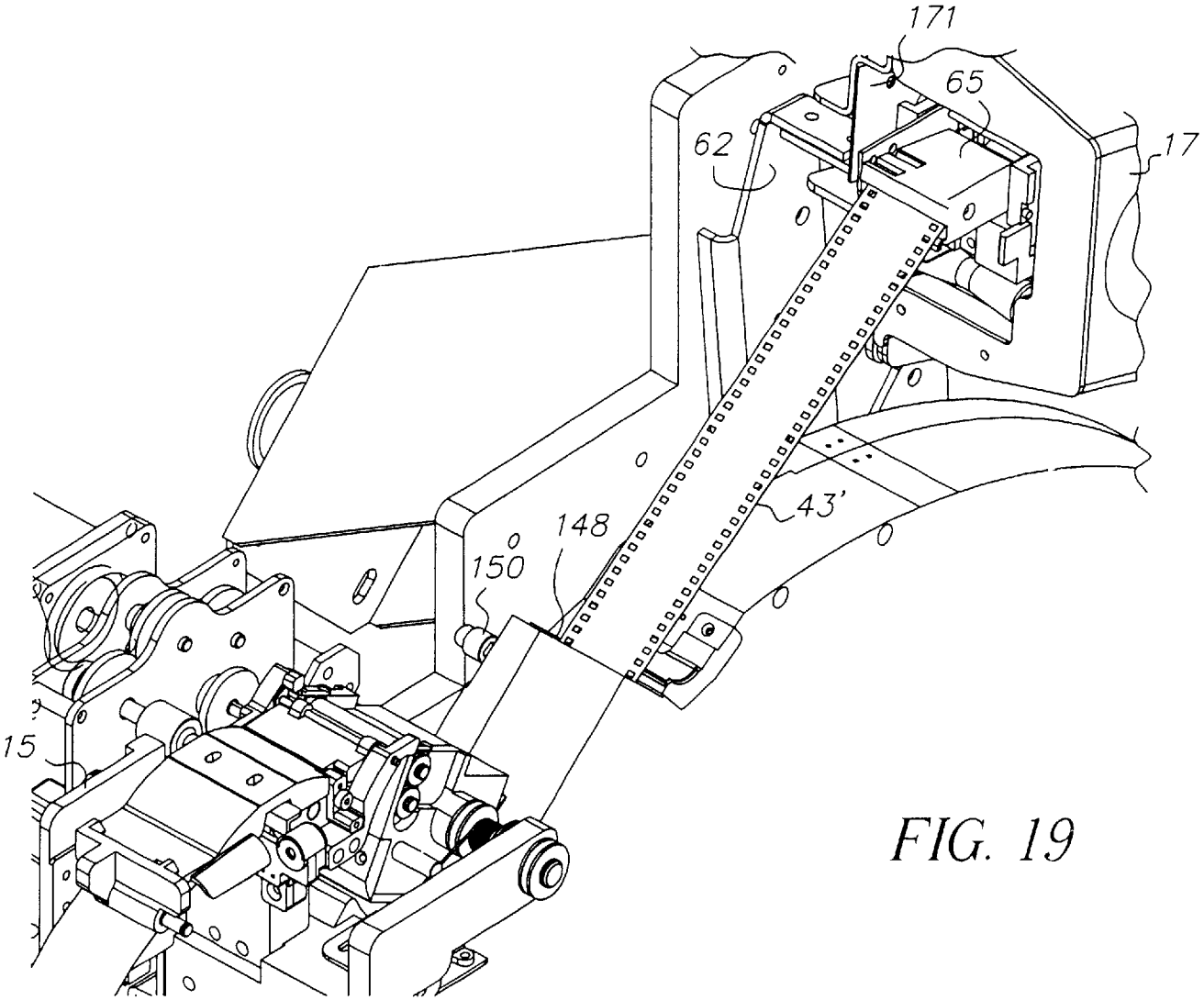
FIG. 19 depicts a film transfer step, wherein a strip of film is transferred from a circular processing drum to a dryer by film sheet gripper rolls attached to a film transfer arm.
Figure 20:
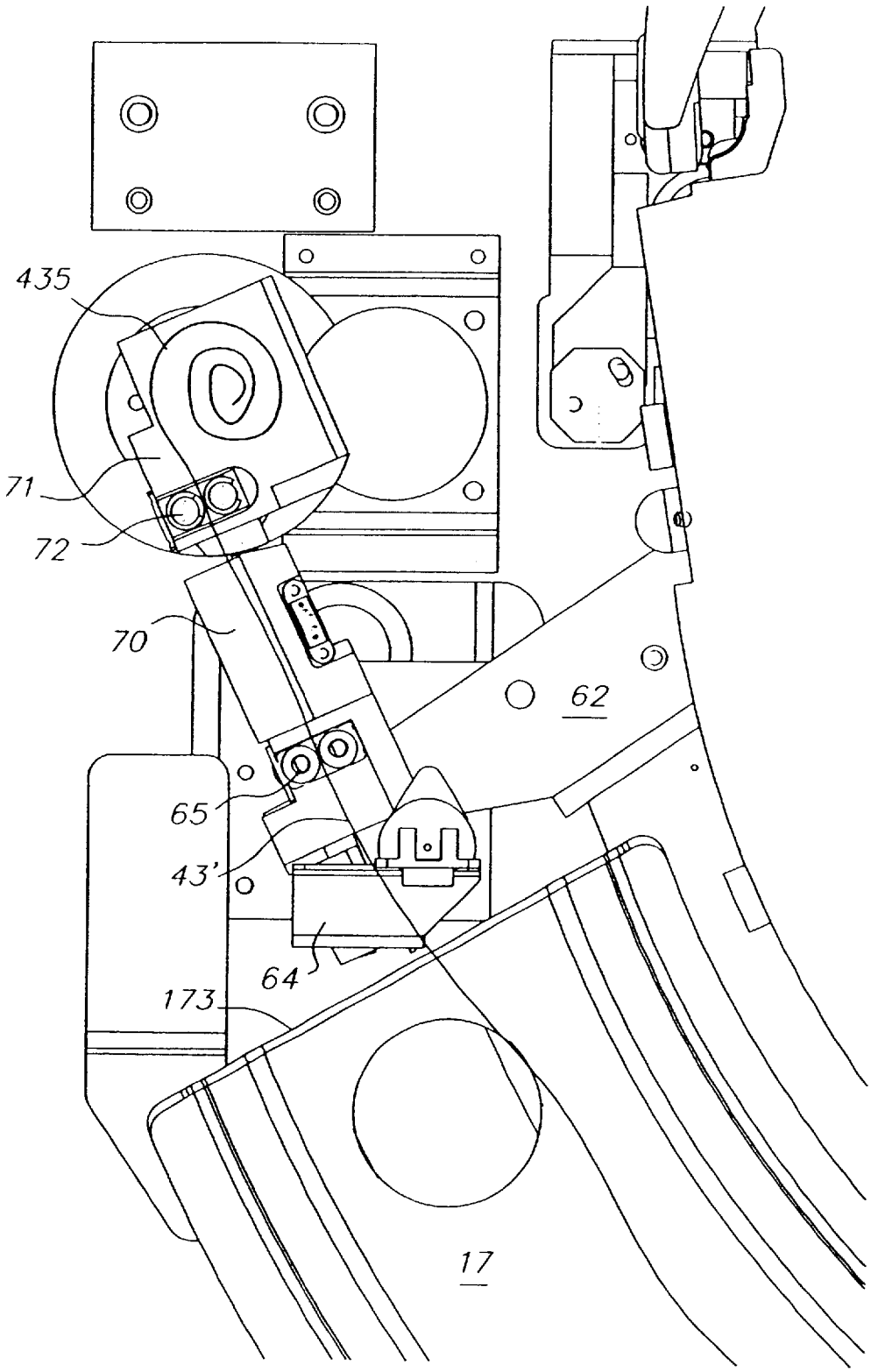
FIG. 20 depicts a film processing step, wherein a strip of film exits a dryer into a scanner festoon box.

Following the chemical processing steps, film 43' is transferred to dryer 17 by film transfer arm assembly 60 as described above. As shown in FIG. 19, the strip of film 43' is pulled from circular processing drum 14 through film input slot 148 by film sheet gripper rolls 65 attached to upper transfer arm member 62. Nip rollers 150 provide a first end (corresponding to lead end 432) to film sheet gripper rolls 65. In FIG. 19, film sheet gripper rolls 65 are shown positioned at dryer entrance 171. From this position, film sheet gripper rolls 65 proceed through dryer 17 pulling the film 43' through dryer 17. As shown in FIG. 20, upper film transfer arm member 62 exits dryer 17 at dryer exit 173 and comes into contact with a conduit 70. Film sheet gripper rolls 65 turn to advance the film 43' through conduit 70 and into scanner festoon box 71. Scanner festoon box nip rollers 72 grasp a leading edge of film 43' and force film 43' into scanner festoon box 71 forming scanner film roll 435. Scanner festoon box nip rollers 72 advance film 43' into scanner festoon box 71 a specific distance equal to the predetermined length of film 43' so that the tail end of film 43' remains nipped between scanner festoon box nip rollers 72 to go to the scanner.

Figure 21:
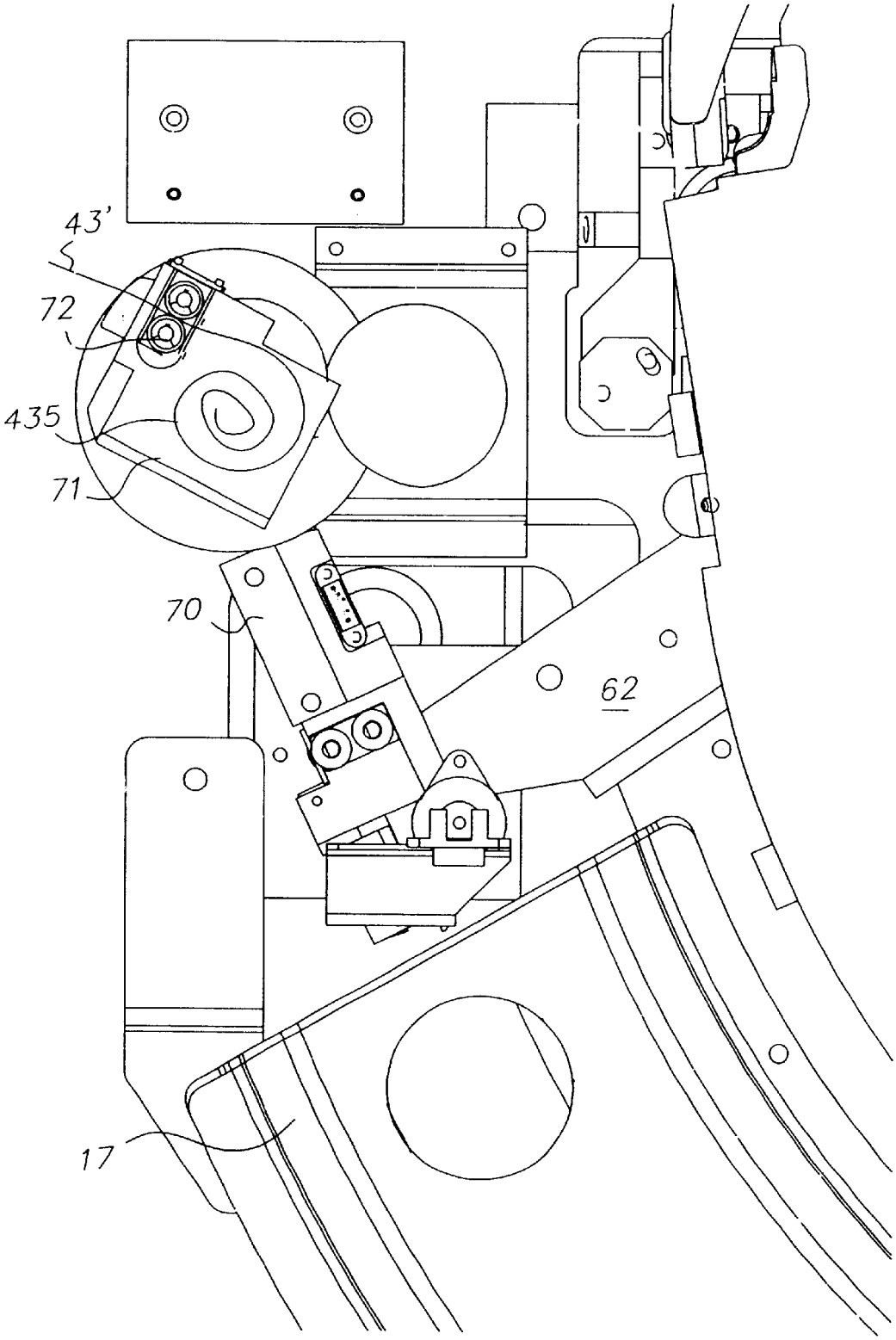
FIG. 21 depicts a film processing step, wherein a strip of film exits a festoon box and proceeds to a scanner.

In one embodiment, film 43' may be further processed by transporting the film 43' to scanner 18'. As shown in FIG. 21, scanner festoon box 71 rotates from an initial position (as shown in FIG. 20) to a secondary position so that the film 43' may be fed to scanner 18'. Scanner 18' may supply image data to computer 2000 or a remote computer (not shown) for further image processing. Following scanning, the film 43' may be packaged as a film roll or as strips of film and returned to the customer along with scanned photographs in electronic format on an electronic disc if desired.

A number of commercially available films may be loaded according to the film-loading method described above, namely, wherein the film is separated from its corresponding film cartridge during processing. Suitable films, which may be used in this particular film-loading method, include, but are not limited to, 135 mm film. Desirably, 135 mm film is loaded into the photographic processor of the present invention according to this method.

The photographic processor of the present invention may be used to process one or more types of film. Suitable films include, but are not limited to, APS film, 135 mm film, etc. Desirably, the photographic processor of the present invention is designed to process APS film, 135 mm film, or both APS and 135 mm film. The photographic processor of the present invention may be categorized as a "single-roll" processing unit given that the circular processing drum only processes one roll of film at a time. However, it should be noted that the photographic processor of the present invention is capable of processing multiple rolls or batches of film at a given time. For example, one roll of film may be in the circular processing drum, while a second roll of film is in the dryer and a third roll of film is in the scanner, or multiple rolls of film can be spliced together to form a batch and accordingly processed.

The photographic processor may include other components other than those described in FIGS. 1–21. For example, the photographic processor may include an operator interface control panel operationally associated with computer 2000 (FIG. 1), a display screen; a control unit, wherein the control unit accepts input from a processor user, provides machine settings to one or more components of the processor based on the input of the user, and controls and executes a processing operation of the processor, and multiple film loading doors on an outer surface of the photographic processor housing. In one desired embodiment of the present invention, the photographic processor is used to process APS film and 135 mm film. In this embodiment, the photographic processor has two separate film loading doors on an outer surface of the photographic processor housing, one for an APS film cartridge and the other for a 135 mm film cartridge.

The photographic processor of the present invention may come in a variety of sizes depending on a number of factors including, but not limited to, the desired processing, the desired size of the circular processing drum, the desired storage capacity of the chemical delivery system, and the desired storage capacity of the waste collection reservoir. One of the benefits of the photographic processor of the present invention is the ability to place the photographic processor in a given room without occupying a large amount of space.

Another benefit of the photographic processor of the present invention is that the only requirement necessary to operate the photographic processor in a given room is a source of electricity. Since the photographic processor of the present invention can operate with working strength chemistry, the processor does not require a water source or drain for processing chemicals. A minimum amount of processing chemicals is needed to operate the photographic processor of the present invention due to the unique design of the circular processing drum. Further, a minimum amount of chemical waste is generated due to the design of the circular processing drum.

The circular processing drum of the photographic processor may vary in size depending on a number of factors including, but not limited to, the type of film processed, the length of the film processed, the width of the film processed, and the desired overall dimensions of the photographic processor. In one embodiment of the present invention, the length of the drum (i.e., the dimension perpendicular to the diameter of the drum) is substantially equal to the sum of (1) a thickness of the front wall of the drum, (2) a thickness of the back wall of the drum, and (3) a width of the strip of processible film. In a further embodiment of the present invention, the drum has a circumference, which is slightly greater than largest length of the roll film.

The photographic processor of the present invention may use any conventional chemical delivery system known in the art as long as the chemical delivery system is capable of inputting one or more processing fluids into the circular processing drum. Suitable chemical delivery systems deliver one or more processing fluids including, but not limited to, a developing solution, a bleach solution, a fix solution, a wash solution, or a combination thereof, parts thereof or concentrates thereof. Desirably, the chemical delivery system comprises one or more separate containers for each of the processing fluids. For example, the chemical delivery system may comprise one or more separate containers containing a developing solution, one or more separate containers containing a bleach solution, one or more separate containers containing a fix solution, and one or more separate containers containing a wash solution. In one embodiment of the present invention, the chemical delivery system used in the photographic processor comprises one container of developing solution, one container of bleach solution, one container of fix solution, and at least one container of wash solution.

Desirably, the photographic processor of the present invention utilizes a chemical delivery system comprising "working strength" chemical solutions. As used herein, the term "working strength" is used to describe chemical solutions, which are prepackaged in separate containers at concentrations that do not require dilution with other solutions (i.e., a source of water), and can be used as is. However, the present invention is not limited to working strength solutions and as noted above concentrates that are measured, diluted and/or optionally heated on board can also be used.

Further, the photographic processor of the present invention may use any conventional chemical removal system to remove one or more processing fluids from the circular processing drum. Suitable chemical removal systems include, but are not limited to, a suction device or a drain 3000 (FIG. 14) in the side wall of the circular processing drum. Typically, the chemical removal system further comprises a chemical waste reservoir 3002 (FIG. 14) for storing one or more processing fluids removed from the drum. Desirably, the chemical waste reservoir is designed to contain all of the waste resulting from the use of all of the processing fluids contained in the chemical delivery system.

As discussed above, the photographic processor of the present invention uses a minimum amount of photoprocessing chemicals, and consequently generates a minimum amount of chemical waste.

The dryer of the invention should be capable of drying the processed film. The dryer may use air and/or radiant heat to dry the processed film. Desirably, the dryer has a capacity, which minimizes the amount of dwell time within the dryer. Also, it is preferable that the dryer be compact and positioned next to the circular processing drum as shown in FIGS. 1–2 above.

The photographic process of the present invention may comprise contacting a strip of film with one or more processing fluids selected from a developing solution, a bleach solution, a fix solution, a wash solution, or a combination thereof. In one embodiment, the photographic process comprises a contacting step, which comprises (i) inputting a developing solution into the circular processing drum; (ii) inputting a bleach solution into the circular processing drum; (iii) inputting a fix solution into the circular processing drum; and (iv) inputting at least one wash solution into the circular processing drum. The contacting step of the process may further comprise separate removal steps following a washing solution input step. As an alternative, the process may comprise inputting a developing solution into the drum; inputting a fix solution into the drum; inputting a bleach solution into the drum; and inputting at least one wash solution into the drum.

During the processing of photographic material or film, it is desired to heat processing solutions to a temperature appropriate for processing. For example, it is known that to process photographic material these processing solution temperatures can range from ambient to 150° F., depending on the processing cycle and specific processing step. Often the most critical temperature for the photographic process is associated with the development reaction. It is preferable that the internal surfaces of the circular processing drum be at the same temperature as the developer solution used to process the photographic material or film in order to avoid thermal gradients in the developer solution while it is in contact with the photographic media or film. These thermal gradients result in non-uniform development and, thereby, unacceptable images.

Figure 30:
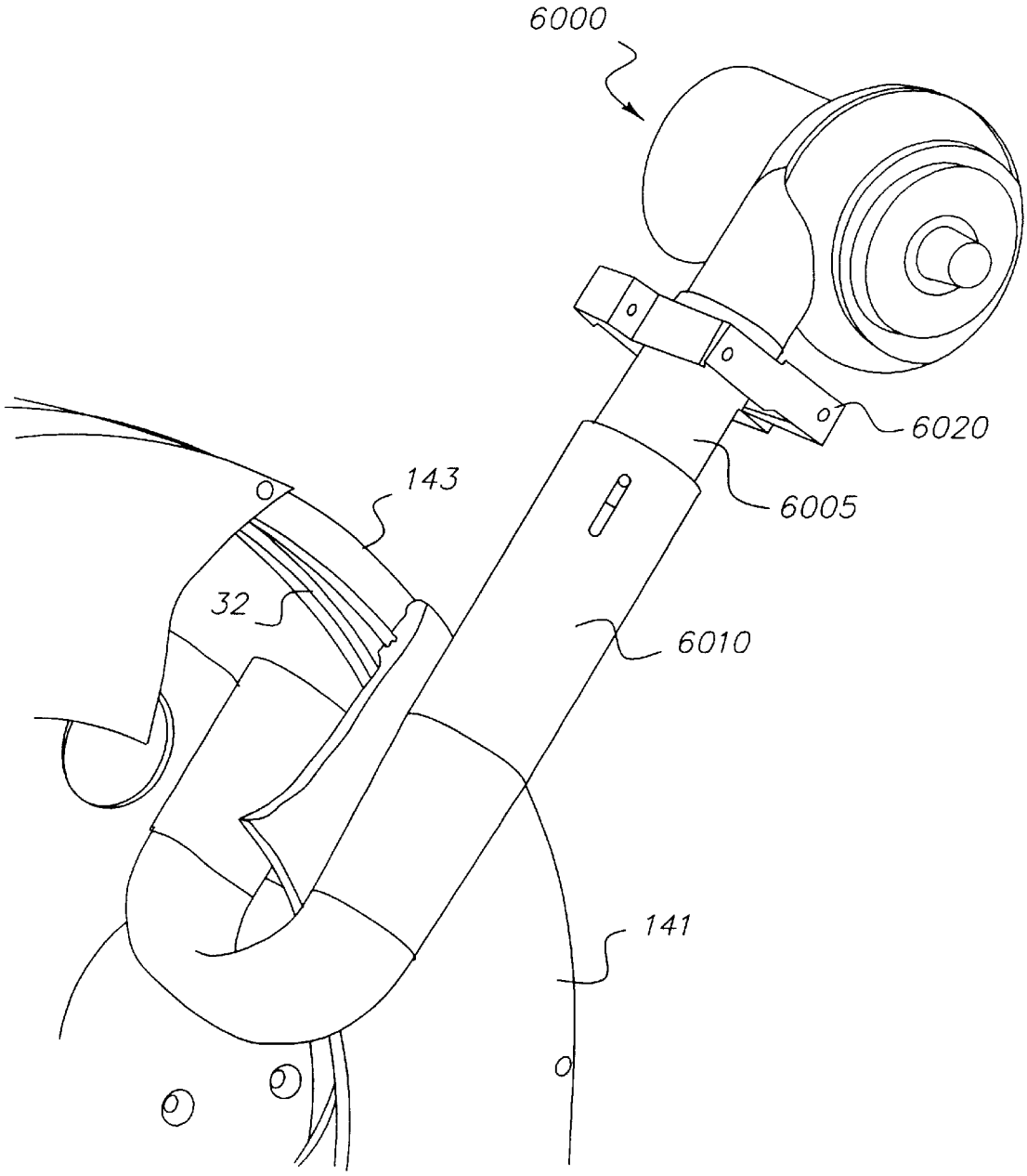
FIG. 30 depicts a heat gun using a directed air path to heat the internal surfaces of a moving processing drum.
Figure 31:
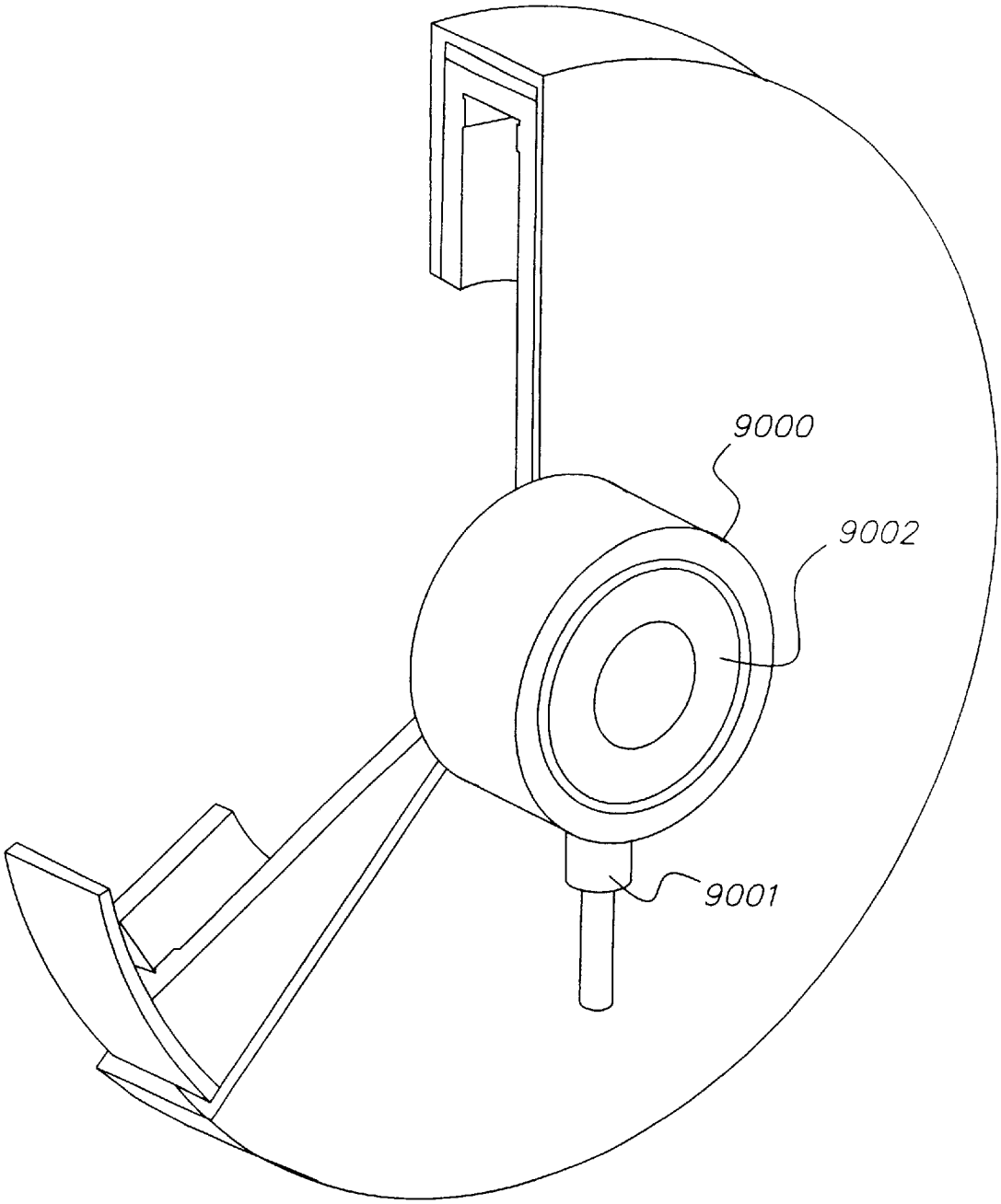
FIG. 31 depicts a slip ring that can be used to power an electrical heater used to heat a moving drum.

FIGS. 22A–22B and 23–29 illustrate different embodiments of the use of thermally conductive materials, thermally non-conductive materials, and heating sources used for heating circular processing drum 14 or 14' of the present invention in order to prevent these thermal gradients and thus image non-uniformities during the development process. FIGS. 22A–22B and 23–29 illustrate only a portion of circular processing drum 14 or 14' necessary for understanding the operation of the heating system of the present invention. FIGS. 30 and 31 show two heating methods that can be employed to heat the drum while the drum is rotating.

Figure 22B:
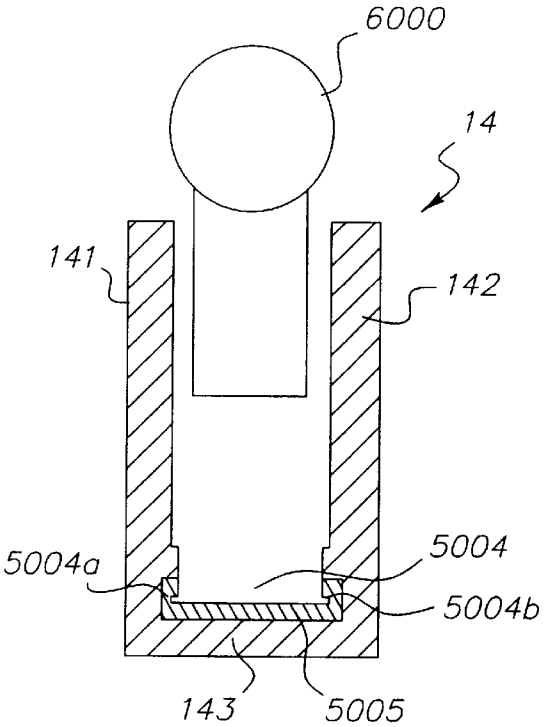
FIG. 22B illustrates a processing drum similar to the drum of FIG. 22A, except that the inserted thermally conductive track includes side guides for photographic media or film.
Figure 22A:
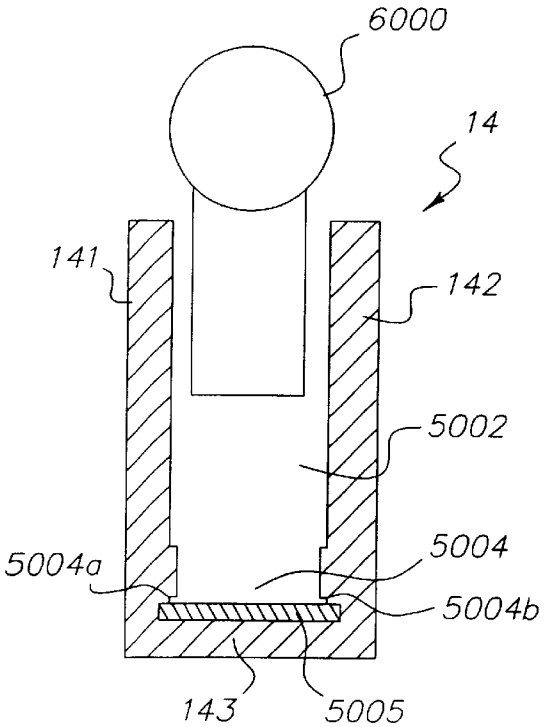
FIG. 22A depicts a cross section of a circular processing drum in accordance with the present invention, where the drum is made of a thermally non-conductive material with a thermally conductive material used as an insert for the bottom of a track that is itself passively heated using a heat gun.

Referring to FIG. 22A, a first embodiment of a heating system is shown. In the embodiment of FIG. 22A, a section of drum 14 including front wall 141, back wall 142, and side wall 143 is shown. Walls 141, 142 and 143 are made of a thermally non-conductive material. In order to heat drum 14 to the temperature of the developing solution used in drum 14 and thereby reduce the thermal gradients associated with the development reaction, the embodiment of FIG. 22A includes an insert 5005 made of thermally conductive material attached to the inside surface of side wall 143 so as to extend around the inside perimeter of drum 14. As shown in FIG. 22A, front wall 141, back wall 142 and thermally conductive insert 5005 define a processing chamber 5002 for holding processing solution therein, and a processing path 5004 which is a circular processing path along which a photographic material or film is conveyed prior to processing. Thermally conductive insert 5005 is heated using a heat gun 6000. To ensure that the inside perimeter is uniformly heated, drum 14 is rotated under the heat gun during heating thereby heating at least processing path 5004 to an appropriate temperature for processing of the photographic material. Front wall 141, back wall 142, and side wall 143 are made of thermally non-conductive material thus insulating the walls of processing chamber 5002 and the backside of thermally conductive insert 5005. This insures that the heat from the heated thermally conductive insert 5005 is not lost to the surrounding environment thus reducing thermal gradients during the development process.

In a preferred embodiment as shown in FIG. 22A, processing path 5004 includes grooves 5004*a* and 5004*b* for the insertion of the edges of the photographic material or film to facilitate the transporting of the photographic material or film along an inner peripheral surface of side wall 143. As shown in FIG. 22*b*, these grooves could be a part of thermally conductive insert 5005.

Materials with thermal conductivities greater than 0.00147 Watt/cm/K are acceptable for use as thermally conductive insert 5005, while thermal conductivities less than 0.00147 Watt/cm/K can be used as thermally nonconductive materials (insulators). Aluminum (2.36 Watt/cm/K), copper 3.83 Watt/cm/K), iron (0.76 Watt/cm/K), stainless steel (0.163 Watt/cm/K) or borosilicate glass (0.12 Watt/cm/K) can serve as thermally conductive materials for drum 14. These materials have high thermal conductivity but 1) some are reactive to the processing chemicals leading to unacceptable performance and 2) require expensive manufacturing processes relative to, for example, injection molding processes to make the circular processing drum.

Thermally conductive materials that are chemically nonreactive with the chemical processing solutions and that can be injection molded are preferred. Examples of a class of such materials are thermally conductive polymers. Thermally conductive polymers are known in the trade. Two examples of these materials from LPN Engineering Plastics, Inc. (475 Creamery Way, Eaton, Pa. 19341) are KONDUIT OTF212-11 (0.010 Watt/cm/K) and KONDUIT OTF202-10 (0.022 Watt/cm/K). Examples are materials from Cool Polymer (333 Strawberry Field Road, Warwick, R.I. 02886) include: RS007 (0.035 Watt/cm/K), E2 (0.20 Watt/cm/K), RB019 (0.20 Watt/cm/K), and RB020 (0.20 Watt/cm/K). The last three materials have thermal conductivities like that of stainless steel. Another acceptable thermally conductive material is NORYL N190X ((0.0024 Watt/cm/K) from North American Commercial. Non-thermally conducting materials (insulating materials) that can be used include PVC (0.001297 Watt/cm/K) or chlorinated CPVC also known as high temperature PVC (0.001369 Watt/cm/K).

Figure 23:
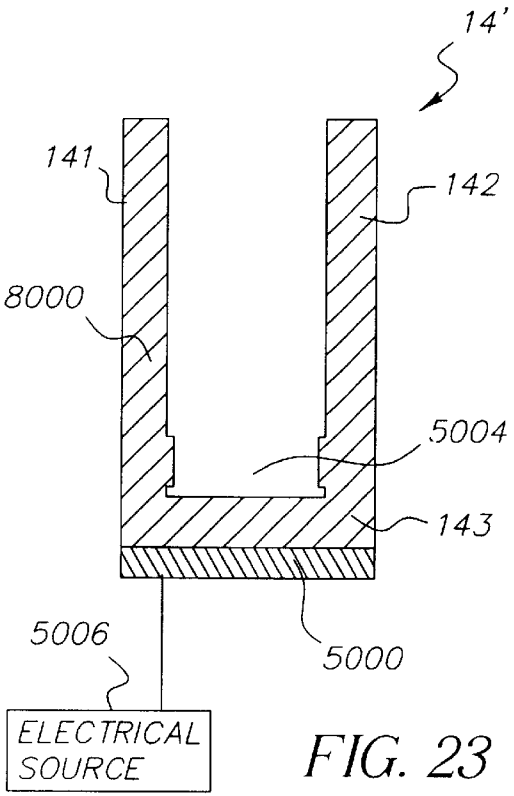
FIG. 23 depicts a cross section of a circular processing drum made with a thermally conductive material that is itself actively heated from the outside of the drum.

FIG. 23 illustrates drum 14' similar to drum 14 of FIG. 22A–22B. However, in drum 14' the entire drum including front wall 141, back wall 142, and side wall 143 are made of thermally conductive material 8000. This drum configuration allows the drum to be additionally or exclusively heated from the outside of the drum. The outside heater could include a heating element or material 5000, such as a resistive heating element, attached to, mounted on or wrapped around an outer surface of side wall 143 so as to extend around a perimeter of drum 14'. Heating element or material 5000 could be, but is not limited to, a heat tape or a flexible heater. The wrapped heating element or material 5000 could be directly attached to the drum or brought in contact with a static (non-moving) drum using a brake shoe-drum like arrangement. Heating element or material 5000 is adapted to be energized or heated and thereby heat at least circular processing drum 14' and processing path 5004 to an appropriate temperature for processing of the photographic material. Within the context of the present invention, heating element or material 5000 can be heated or energized in a controlled manner by an electrical source 5006 which supplies an electrical current to heating element or material 5000 for heating thermally conductive material 8000 used to construct drum 14'. Use of electrical source 5006 permits a controlled heating of thermally conductive material 8000 for heating processing path 5004 and/or maintaining processing path 5004 at a temperature appropriate for processing of the photographic material.

Figure 24:
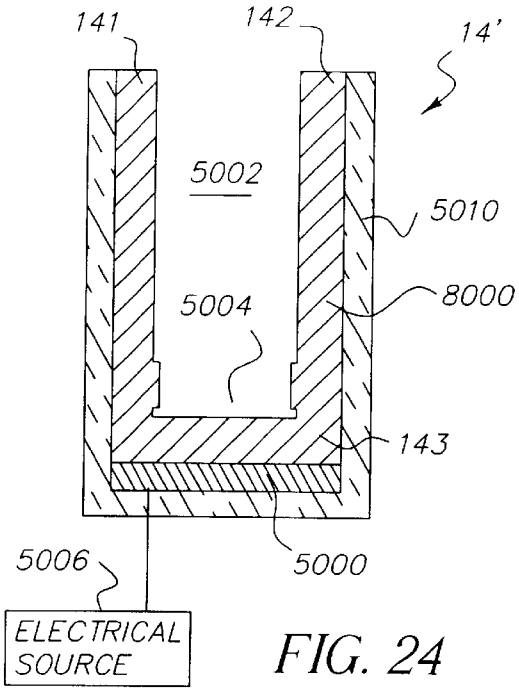
FIG. 24 illustrates a processing drum similar to the drum of FIG. 23 except that the thermally conductive material is covered with a thermally non-conductive material.

FIG. 24 illustrates drum 14' of FIG. 23 along with heating element 5000 provided on an outside surface of side wall 143. In the embodiment of FIG. 24, an insulator or insulating material 5010 is provided around an outer or peripheral surface of front wall 141, back wall 142, and side wall 143 made of thermally conductive material 8000 to maintain circular processing drum 14' and processing path 5004 at the noted appropriate temperature for proper processing of photographic material in processing path 5004.

Figure 25:
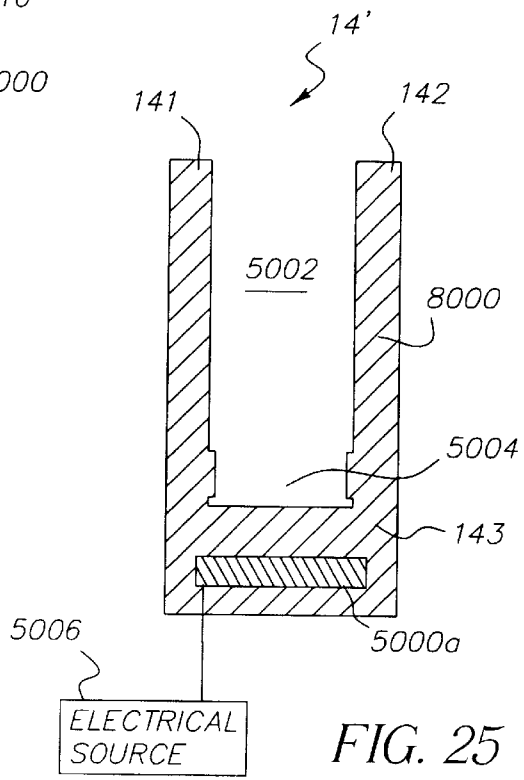
FIG. 25 illustrates a processing drum similar to the drum of FIG. 23 except that a heater is embedded in an injection molded thermally conductive polymer.

FIG. 25 illustrates a further embodiment of a heating system in accordance with the present invention. Like FIG.

23, FIG. 25 illustrates processing drum 14' having front wall 141, back wall 142 and side wall 143 made of thermally conductive material 8000. Also, like the embodiment of FIG. 23, walls 141, 142 and 143 define a processing chamber 5002 and a processing path 5004 for the passage of photographic material there-through during processing. In this embodiment, the heating element or material is embedded into side wall 143. More specifically, as shown in FIG. 25, a heating element or material 5000*a* is embedded into side wall 143 as shown, and extends around a perimeter of drum 14. Like the embodiment of FIG. 23, heating element 5000*a* of FIG. 25 is adapted to be heated so as to heat at least circular processing drum 14' and processing path 5004 to an appropriate temperature for processing of photographic material.

Figure 26:
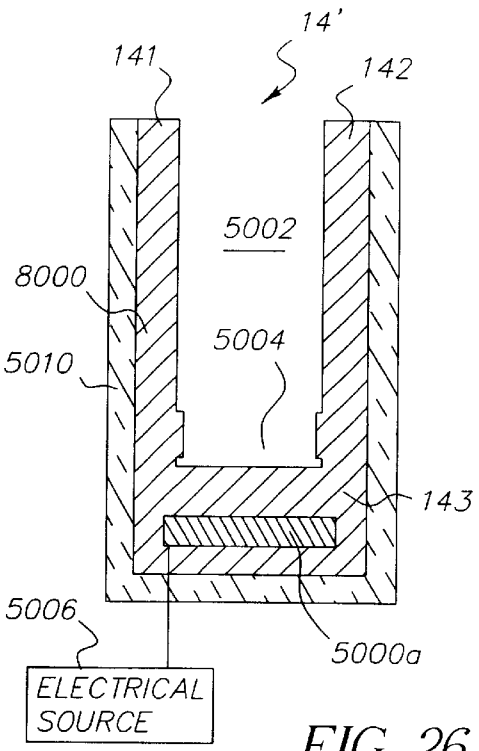
FIG. 26 illustrates a processing drum similar to the drum of FIG. 25 except that the thermally conductive material is covered with a thermally nonconductive material.

FIG. 26 illustrates drum 14' of FIG. 25 with an insulator or insulating material 5010 wrapped around a peripheral surface of front wall 141, back wall 142 and side wall 143. Insulating material 5010 helps maintain processing drum 14' and processing path 5004 at an appropriate temperature for processing.

Figure 27:
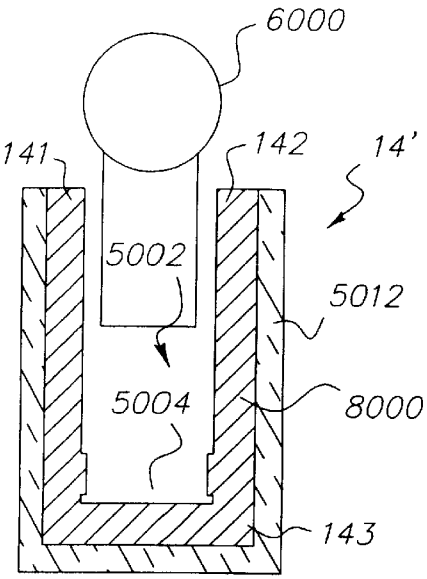
FIG. 27 depicts a cross section of a circular processing drum made of standard plastic that is covered with a thermally non-conductive material and is passively heated.

FIG. 27 illustrates a further embodiment of a heating system for processing drum 14' in accordance with the present invention. In the embodiment of FIG. 27, processing drum 14' includes front wall 141, back wall 142 and side wall 143 as in the previous embodiments. In the embodiment of FIG. 27 as in FIG. 23, processing drum 14' itself is made of a thermally conductive material 8000. In the embodiment of FIG. 27, an insulated material or insulator 5012 is wrapped around the outer periphery of front wall 141, back wall 142 and side wall 143. In the embodiment of FIG. 27, the drum is heated using heat gun 6000 to maintain the drum at an appropriate temperature.

Figure 28:
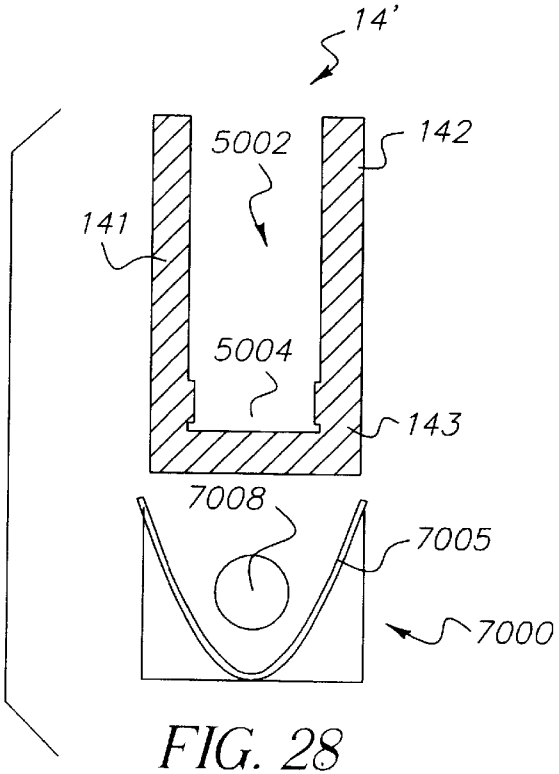
FIG. 28 illustrates a processing drum similar to the drum of FIG. 22 except that the thermally conductive material is passively heated with a radiant heating source.

FIG. 28 illustrates drum 14' using alternative heating sources alone or in conjunction with heat gun 6000 as shown in FIG. 27. In the embodiment of FIG. 28, a radiant heater 7000 is located outside drum 14 and heats the backside of side wall 143. Alternatively, radiant heater 7000 could be mounted near the axle of the drum thus radiating and thereby heating the frontside of side wall 143. Radiant heater 7000 comprises a high intensity light source 7008 and a parabolic mirror 7005. To assure uniform heating of the internal track or processing path 5004, drum 14' is rotated during heating. If radiant heater 7000 is mounted inside drum 14', then an insulating material or insulator could be wrapped around an exterior surface of drum 14' to help maintain the drum at the appropriate temperature for processing.

Figure 29:
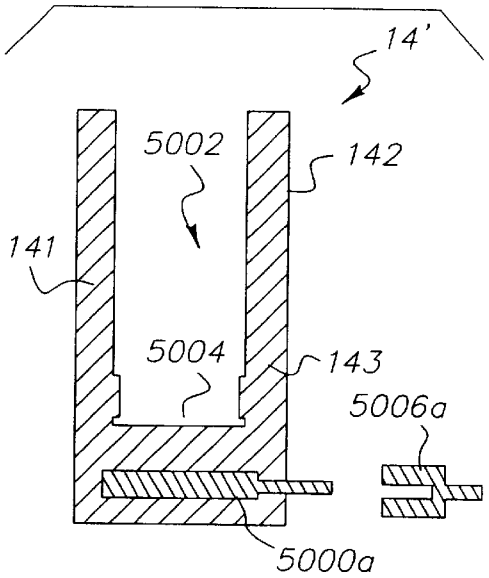
FIG. 29 depicts an actively heated drum using a moveable plug in module for power to activate the heater for a static drum.

FIG. 29 illustrates a method of making electrical contact for the embodiments wherein a resistance heating element is used to heat drum 14' as illustrated in FIG. 25. In FIG. 29, an electrical contact between resistance heating element or material 5000*a* and controller 5006 such as shown in FIG. 25 is made using an electrical connection 5006*a* that is mounted on a movable surface. When drum 14' is not rotating, electrical connection 5006*a* is moved so as to engage resistance heating element 5000*a* and commence heating drum 14'. When drum 14' is rotated as part of the process cycle, electrical connection is disconnected by moving connection 5006*a* away from drum 14'.

An example of heat gun 6000 is shown in FIG. 30. Heat gun 6000 itself is a commercially available unit such as that obtained from Milwuakee Products. Heat gun 6000 includes a mounting bracket 6020 adapted to secure heat gun 6000 to a fixture on which drum 14 or 14' is mounted. A nozzle 6005 of heat gun 6000 is extended using simple heat resistant tubing 6010 such that the extension allows heated air to directly impinge onto an internal surface of the track that makes up processing path 5004. Drum 14 or 14' is rotated during heating with the heat gun 6000 or radiant heater to insure uniform heating of the surface.

Optionally, drum 14' can be heated electrically while the drum is rotating by use of, for example, a slip ring as shown in FIG. 31. The slip ring includes a stationary power supply 9001 and a stationary fixture 9000 that, when powered, energizes a rotating assembly 9002 to which the electrical heating elements that are attached to or mounted on or wrapped around an outer surface of side wall 143 so as to extend around a perimeter of drum 14' are connected. In this fashion, electrical resistance heating can be used to heat the drum 14' when drum 14' is non-rotating or rotating, thus maintaining the temperature of the track or processing path even during the processing cycle when the drum must be rotating to process the photographic material or film.

Therefore, in FIGS. 22A–22B and 23–29, when processing photographic material or film, processing solution is introduced into processing chamber 5002 of circular drum 14 or 14'. In addition to the processing solution, photographic material is introduced into processing path 5004 of drum 14 or 14' to contact the processing solution and process the photographic material in the manner as described with reference to FIGS. 1–21. In order to maintain the processing solution at a temperature appropriate for processing, combinations of a thermally conductive material, a thermally non-conductive material, and heating sources as disclosed in each of the embodiments of FIGS. 22A–22B and 23–29 are energized to heat at least the processing path to an appropriate temperature for processing of the photographic material. In order to maintain the processing path at the heated temperature, an insulator or insulating material is provided around a peripheral surface of the front wall, back wall and side wall of the drum. As an option, in order to achieve a more rapid heating of the drum, the heating can commence when no solution is in the drum.

Accordingly, the present invention provides for a heating system which places heat at a film processing path or film plane surface which is generally, the place where the heat is required the most. With the system and method of the present invention, it is not necessary to heat an entire processing chamber. With the system and method of the present invention, processing drum 14 or 14' is heated in a manner which requires less warm up time and gives better film uniformity results. The system and method of the present invention also enables the heating of the drum to a controlled temperature in a manner which requires less power and warm up time between processed films, which helps increase the throughput through the processor.

The invention has been described in detail with particular reference to certain preferred embodiments thereof, but it will be understood that variations and modifications can be effected within the spirit and scope of the invention.

What is claimed is:

1. A photographic processor comprising:

a circular processing drum having a front wall, a back wall, and a side wall connecting the front wall to the back wall and extending around a perimeter of the drum, said front wall, back wall and side wall defining a processing chamber for holding processing solution therein and a processing path within said processing chamber along which a photographic material is conveyed during processing; and a heating material provided on an outer surface of said side wall so as to extend around the perimeter of said drum, said heating material being adapted to be heated to heat at least the circular processing drum and the processing path to an appropriate temperature for processing of the photographic material.

2. A photographic processor according to claim 1, further comprising:

an insulating material provided along a peripheral surface of said front wall, said back wall and said heating material to maintain the circular processing drum and said processing path at said appropriate temperature.

3. A photographic processor according to claim 1, further comprising:

a device for controllably heating the heating material.

4. A photographic processor comprising:

a circular processing drum having a front wall, a back wall, and a side wall connecting the front wall to the back wall and extending around a perimeter of the drum, said front wall, back wall and side wall defining a processing chamber for holding processing solution therein and a processing path within said processing chamber along which a photographic material is conveyed during processing; and a heating material embedded into said side wall and extending around the perimeter of said drum, said heating material being adapted to be heated to heat at least the circular processing drum and the processing path to an appropriate temperature for processing of the photographic material.

5. A photographic processor according to claim 4, further comprising:

an insulating material provided along a peripheral surface of said front wall, said back wall and said side wall to maintain the circular processing drum and said processing path at said appropriate temperature.

6. A photographic processor according to claim 4, further comprising:

a device for controllably heating the heating material.

7. A photographic processor comprising:

a circular processing drum having a front wall, a back wall, and a side wall connecting the front wall to the back wall and extending around a perimeter of the drum, said front wall, back wall and side wall defining a processing chamber for holding processing solution therein and a processing path within said processing chamber along which a photographic material is conveyed during processing;

wherein said circular processing drum is made of a thermally conductive material and is adapted to be heated to heat at least the processing path to an appropriate temperature for processing of the photographic material.

8. A photographic processor according to claim 7, further comprising:

an insulating material provided along a peripheral surface of said front wall, said back wall and said side wall to maintain the circular processing drum and said processing path at said appropriate temperature.

9. A photographic processor according to claim 7, further comprising:

a device for heating the circular processing drum.

10. A photographic processor according to claim 9, wherein said heating device comprises a radiant heat source or a heat gun.

11. A photographic processor comprising:

a circular processing drum having a front wall, a back wall, and a side wall connecting the front wall to the back wall and extending around a perimeter of the drum, an interior surface of said side wall and opposing portions of said back and front wall adjacent to said side wall defining a film processing path along which film to be processed is conveyed; and a thermally conductive insert provided in said side wall in a vicinity of the interior surface of said side wall, said thermally conductive insert being adapted to be heated to heat at least the interior surface of the side wall and the processing path to an appropriate temperature for processing of the photographic material.

12. A photographic processor according to claim 11, wherein said front wall, said back wall and said side wall are made of a thermally non-conductive material.

13. A photographic processor according to claim 11, further comprising a device for heating the thermally conductive insert.

14. A method of processing photographic material comprising the steps of:

introducing a processing solution into a circular processing drum having a front wall, a back wall and a side wall connecting the front wall to the back wall and extending around a perimeter of the drum;

introducing photographic material into a processing path of the processing drum to contact the processing solution and process the photographic material; and energizing a heating material provided on an outer surface of said side wall to heat at least the processing path to an appropriate temperature for processing of the photographic material.

15. A method according to claim 14, further comprising the step of:

maintaining the processing path at said appropriate processing temperature by providing an insulating material around a peripheral surface of said front wall, said back wall and said side wall.

16. A method of processing photographic material comprising the steps of;

introducing a processing solution into a processing drum having a front wall, a back wall and a side wall connecting the front wall to the back wall and extending around a perimeter of the drum;

introducing photographic material into a processing path of the processing drum to contact the processing solution and process the photographic material; and energizing a heating material embedded into the side wall to heat at least the processing path to an appropriate temperature for processing of the photographic material.

17. A method according to claim 16, further comprising the step of:

maintaining the processing path at said appropriate processing temperature by providing an insulating material around a peripheral surface of said front wall, said back wall and said side wall.

* * * * *